US010699524B2

(12) United States Patent
Cuddy et al.

(10) Patent No.: US 10,699,524 B2
(45) Date of Patent: Jun. 30, 2020

(54) GAMING SYSTEM, GAMING DEVICE AND METHOD FOR PROVIDING MULTI-LEVEL PROGRESSIVE AWARDS

(75) Inventors: Ryan W. Cuddy, Reno, NV (US); Eric Satterlie, Reno, NV (US)

(73) Assignee: IGT, Las Vegas, NV (US)

( * ) Notice: Subject to any disclaimer, the term of this patent is extended or adjusted under 35 U.S.C. 154(b) by 2422 days.

(21) Appl. No.: 11/937,326

(22) Filed: Nov. 8, 2007

(65) Prior Publication Data

US 2009/0124362 A1 May 14, 2009

(51) Int. Cl.
*A63F 9/24* (2006.01)
*G07F 17/32* (2006.01)

(52) U.S. Cl.
CPC ..... *G07F 17/3244* (2013.01); *G07F 17/32* (2013.01); *G07F 17/3258* (2013.01)

(58) Field of Classification Search
CPC ..... G07F 17/3244; G07F 17/3255; G07F 17/3267; G07F 17/3258; G07F 17/32
USPC ..... 463/25–29, 40–42, 16, 20
See application file for complete search history.

(56) References Cited

U.S. PATENT DOCUMENTS 4,624,459 A 11/1986 Kaufman
4,695,053 A 9/1987 Vazquez, Jr. et al.
4,856,787 A 8/1989 Itkis
4,926,327 A 5/1990 Sidley
5,078,405 A 1/1992 Jones et al.
5,116,055 A 5/1992 Tracy
5,178,390 A 1/1993 Okada
5,280,909 A 1/1994 Tracy
5,292,127 A 3/1994 Kelly et al.
5,326,104 A 7/1994 Pease et al.
5,342,047 A 8/1994 Heidel et al.
5,344,144 A 9/1994 Canon
5,377,973 A * 1/1995 Jones et al. ..... 463/12
5,449,173 A 9/1995 Thomas et al.
5,472,194 A 12/1995 Breeding et al.
5,472,196 A 12/1995 Rusnak
5,511,781 A 4/1996 Wood et al.
(Continued)

FOREIGN PATENT DOCUMENTS

EP 0984409 3/2000
EP 1 175 928 1/2002
(Continued)

*Primary Examiner* — David L Lewis
*Assistant Examiner* — Matthew D Hoel
(74) *Attorney, Agent, or Firm* — Neal, Gerber & Eisenberg LLP

(57) ABSTRACT

A gaming system and method which provides and tracks bonus sequence eligibility points accumulated by players playing the gaming devices in the gaming system. The gaming system maintains, for one or more players, a plurality of progressive awards, wherein for a specific player, one or more of the progressive awards is based, at least in part, on the quantity of accumulated bonus sequence eligibility points associated with or accumulated by that player. If a player forfeits a bonus sequence eligibility point (due to player inactivity) or otherwise loses a bonus sequence eligibility point (due to not winning a provided bonus sequence), the gaming system contributes at least part of a value of such forfeited or lost bonus sequence eligibility points to increase a bonus sequence award maintained by the gaming system.

14 Claims, 9 Drawing Sheets

| Player | Player's Current Accumulated Bonus Sequence Eligibility Points | Total Outstanding Accumulated Bonus Sequence Eligibility Points | Player's Percentage of Winning Bonus Sequence |
|---|---|---|---|
| Player A | 4 | 10 | 40% |
| Player C | 3 | 10 | 30% |
| Player D | 1 | 10 | 10% |
| Player E | 2 | 10 | 20% |

(56) References Cited

U.S. PATENT DOCUMENTS 5,536,016 A 7/1996 Thompson
5,542,669 A 8/1996 Charron et al.
5,564,700 A 10/1996 Celona
5,564,701 A 10/1996 Jones et al.
5,580,309 A 12/1996 Piechowiak et al.
5,584,485 A 12/1996 SoRelle et al.
5,611,535 A 3/1997 Tiberio
5,611,730 A 3/1997 Weiss
5,613,912 A 3/1997 Slater
5,645,486 A 7/1997 Nagao et al.
5,655,961 A 8/1997 Acres et al.
5,702,304 A 12/1997 Acres et al.
5,741,183 A 4/1998 Acres et al.
5,743,523 A 4/1998 Kelly et al.
5,752,882 A 5/1998 Acres et al.
5,761,647 A 6/1998 Boushy
5,766,076 A 6/1998 Pease et al.
5,770,533 A 6/1998 Franchi
5,772,509 A 6/1998 Weiss
5,779,547 A 7/1998 Byrne
5,779,549 A 7/1998 Walker et al.
5,816,918 A 10/1998 Kelly et al.
5,820,459 A 10/1998 Acres et al.
5,830,063 A 11/1998 Brune
5,833,540 A 11/1998 Miodunski et al.
5,836,817 A 11/1998 Acres et al.
5,848,932 A 12/1998 Adams
5,851,149 A 12/1998 Para et al.
5,855,515 A 1/1999 Pease et al.
5,876,283 A 3/1999 Yen
5,876,284 A 3/1999 Acres et al.
5,882,261 A 3/1999 Adams
5,885,158 A 3/1999 Torango et al.
5,890,963 A 4/1999 Potter et al.
5,919,091 A 7/1999 Bell et al.
5,947,820 A 9/1999 Morro et al.
5,951,011 A 9/1999 Cherry
5,957,775 A 9/1999 Goldman
5,980,384 A 11/1999 Barrie
5,997,002 A 12/1999 Kelly et al.
5,997,400 A 12/1999 Seelig et al.
5,997,401 A 12/1999 Crawford
6,001,016 A 12/1999 Walker et al.
6,004,207 A 12/1999 Wilson, Jr. et al.
6,012,982 A 1/2000 Piechowiak et al.
6,015,344 A 1/2000 Kelly
6,059,289 A 5/2000 Vancura
6,065,752 A 5/2000 Weiss
6,077,162 A 6/2000 Gauselmann
6,089,977 A 7/2000 Bennett
6,089,980 A 7/2000 Walker et al.
6,110,041 A 8/2000 Walker et al.
6,126,542 A 10/2000 Fier
6,142,872 A * 11/2000 Walker et al. ..... 463/16
6,159,098 A 12/2000 Slomiany et al.
6,162,122 A 12/2000 Acres et al.
6,190,255 B1 2/2001 Thomas et al.
6,206,782 B1 3/2001 Olsen
6,210,275 B1 4/2001 Olsen
6,210,276 B1 4/2001 Mullins
6,224,482 B1 5/2001 Bennett
6,231,445 B1 5/2001 Acres
6,241,608 B1 6/2001 Torango
6,244,958 B1 6/2001 Acres
6,254,483 B1 7/2001 Acres
6,257,981 B1 7/2001 Acres et al.
6,293,866 B1 * 9/2001 Walker et al. ..... 463/20
6,296,569 B1 10/2001 Acres
6,302,793 B1 10/2001 Fertitta, III et al.
6,311,976 B1 11/2001 Yoseloff et al.
6,312,332 B1 11/2001 Walker et al.
6,312,333 B1 11/2001 Acres
6,319,122 B1 11/2001 Packes, Jr. et al.
6,319,125 B1 * 11/2001 Acres ..... 463/25
6,336,857 B1 1/2002 McBride
6,336,862 B1 1/2002 Brune
6,364,768 B1 4/2002 Acres et al.
6,371,852 B1 4/2002 Acres
6,375,567 B1 4/2002 Acres
6,375,568 B1 4/2002 Roffman et al.
6,375,569 B1 4/2002 Acres
6,431,983 B2 8/2002 Acres
6,435,511 B1 8/2002 Vancura et al.
6,533,273 B2 3/2003 Cole et al.
6,565,434 B1 5/2003 Acres
6,575,832 B1 6/2003 Manfredi et al.
6,592,459 B2 7/2003 Parra et al.
6,592,460 B2 7/2003 Torango
6,607,438 B2 8/2003 Baerlocher et al.
6,607,441 B1 8/2003 Acres
6,612,574 B1 9/2003 Cole et al.
6,612,575 B1 9/2003 Cole et al.
6,620,046 B2 9/2003 Rowe
6,626,758 B1 9/2003 Parham et al.
6,632,141 B2 10/2003 Webb et al.
6,648,753 B1 11/2003 Tracy et al.
6,652,378 B2 11/2003 Cannon et al.
6,656,047 B1 12/2003 Tarantino et al.
6,676,512 B2 1/2004 Gauselmann
6,692,354 B2 2/2004 Tracy et al.
6,709,330 B1 3/2004 Klein et al.
6,712,697 B2 3/2004 Acres
6,726,563 B1 4/2004 Baerlocher et al.
6,733,390 B2 * 5/2004 Walker et al. ..... 463/23
6,749,510 B2 6/2004 Giobbi
6,758,748 B2 7/2004 Byrne
6,776,715 B2 8/2004 Price
6,783,458 B2 * 8/2004 Mead et al. ..... 463/25
6,793,578 B2 9/2004 Luccesi et al.
6,800,030 B2 10/2004 Acres
6,814,664 B2 11/2004 Baerlocher et al.
6,832,958 B2 12/2004 Acres et al.
6,835,132 B2 12/2004 Bennett
6,837,788 B2 1/2005 Cannon
6,869,076 B1 3/2005 Moore et al.
6,887,154 B1 5/2005 Luciano, Jr. et al.
6,910,964 B2 6/2005 Acres
RE38,812 E 10/2005 Acres et al.
6,966,834 B1 11/2005 Johnson
7,011,581 B2 3/2006 Cole et al.
7,018,292 B2 3/2006 Tracy et al.
7,040,982 B1 5/2006 Jarvis et al.
7,056,211 B2 6/2006 Olive
7,077,746 B2 7/2006 Torango
7,104,889 B2 9/2006 Nelson et al.
7,121,942 B2 10/2006 Baerlocher
7,169,041 B2 1/2007 Tessmer et al.
7,223,172 B2 5/2007 Baerlocher et al.
7,303,475 B2 12/2007 Britt et al.
2001/0055990 A1 12/2001 Acres
2002/0014821 A1 2/2002 Kobayashi et al.
2002/0025845 A1 * 2/2002 Cannon ..... 463/16
2002/0138594 A1 9/2002 Rowe
2002/0015342 A1 10/2002 Joseph et al.
2002/0142846 A1 10/2002 Paulsen
2002/0177483 A1 11/2002 Cannon
2002/0183105 A1 12/2002 Cannon et al.
2003/0027625 A1 2/2003 Rowe
2003/0045350 A1 3/2003 Baerlocher et al.
2003/0060259 A1 3/2003 Mierau et al.
2003/0060266 A1 3/2003 Baerlocher
2003/0060279 A1 3/2003 Torango
2003/0064773 A1 4/2003 Baerlocher et al.
2003/0064794 A1 * 4/2003 Mead et al. ..... 463/25
2003/0078101 A1 4/2003 Schneider et al.
2003/0083943 A1 5/2003 Adams et al.
2003/0090063 A1 5/2003 Jarvis et al.
2003/0092484 A1 5/2003 Schneider et al.
2003/0144965 A1 7/2003 Prasad et al.
2003/0186733 A1 10/2003 Wolf et al.
2003/0211880 A1 11/2003 Locke
2003/0222402 A1 12/2003 Olive
2003/0228904 A1 12/2003 Acres et al.
2004/0009811 A1 1/2004 Torango

(56) References Cited

U.S. PATENT DOCUMENTS

| | | | | |
|---|---|---|---|---|
| 2004/0033831 | A1 | 2/2004 | Tarantino | |
| 2004/0072615 | A1 | 4/2004 | Maya et al. | |
| 2004/0082373 | A1 | 4/2004 | Cole et al. | |
| 2004/0242297 | A1 | 12/2004 | Walker | |
| 2004/0248641 | A1* | 12/2004 | Jarvis et al. | 463/20 |
| 2005/0003886 | A1 | 1/2005 | Englman et al. | |
| 2005/0020340 | A1 | 1/2005 | Cannon | |
| 2005/0020342 | A1 | 1/2005 | Palmer et al. | |
| 2005/0026679 | A1 | 2/2005 | Lucchesi et al. | |
| 2005/0032573 | A1 | 2/2005 | Acres et al. | |
| 2005/0037832 | A1* | 2/2005 | Cannon | 463/18 |
| 2005/0043088 | A1 | 2/2005 | Nguygen et al. | |
| 2005/0054435 | A1 | 3/2005 | Rodgers et al. | |
| 2005/0119047 | A1 | 6/2005 | Olive | |
| 2005/0143168 | A1 | 6/2005 | Torango | |
| 2005/0153767 | A1 | 7/2005 | Gauselmann | |
| 2005/0176488 | A1 | 8/2005 | Olive | |
| 2005/0209004 | A1 | 9/2005 | Torango | |
| 2005/0239542 | A1 | 10/2005 | Olsen | |
| 2006/0003829 | A1 | 1/2006 | Thomas | |
| 2006/0003835 | A1* | 1/2006 | Olive | 463/25 |
| 2006/0030403 | A1 | 2/2006 | Lafky et al. | |
| 2006/0035705 | A1 | 2/2006 | Jordon | |
| 2006/0040723 | A1* | 2/2006 | Baerlocher et al. | 463/16 |
| 2006/0040732 | A1 | 2/2006 | Baerlocher et al. | |
| 2006/0040733 | A1 | 2/2006 | Baerlocher et al. | |
| 2006/0040734 | A1 | 2/2006 | Baerlocher et al. | |
| 2006/0040736 | A1 | 2/2006 | Baerlocher et al. | |
| 2006/0084496 | A1 | 4/2006 | Jaffe et al. | |
| 2006/0217183 | A1 | 9/2006 | Mierau et al. | |
| 2007/0034732 | A1 | 3/2007 | Baerlocher | |
| 2007/0060297 | A1 | 3/2007 | Hein et al. | |
| 2007/0060314 | A1 | 3/2007 | Baerlocher et al. | |
| 2007/0060321 | A1 | 3/2007 | Vasquez et al. | |
| 2007/0060375 | A1 | 3/2007 | Hein et al. | |
| 2007/0077979 | A1 | 4/2007 | Cohn et al. | |
| 2007/0077990 | A1 | 4/2007 | Cuddy et al. | |
| 2007/0155485 | A1 | 7/2007 | Cuddy et al. | |
| 2007/0191088 | A1 | 8/2007 | Breckner et al. | |
| 2007/0218975 | A1 | 9/2007 | Iddings et al. | |
| 2007/0243925 | A1 | 10/2007 | LeMay et al. | |
| 2007/0243934 | A1 | 10/2007 | Little et al. | |
| 2007/0259714 | A1 | 11/2007 | Block et al. | |
| 2008/0293481 | A1 | 11/2008 | Davies | |
| 2008/0300051 | A1 | 12/2008 | Walker et al. | |
| 2009/0075722 | A1 | 3/2009 | Louie et al. | |

FOREIGN PATENT DOCUMENTS

| | | |
|---|---|---|
| GB | 2 144 644 | 3/1985 |
| GB | 2 191 030 | 12/1987 |
| GB | 2 222 712 | 3/1990 |
| GB | 2 333 880 | 8/1999 |
| GB | 2 353 128 | 2/2001 |
| WO | WO 2000/12186 | 3/2000 |
| WO | WO 2000/32286 | 6/2000 |
| WO | WO 2003/049054 | 6/2003 |
| WO | WO 2005/015826 | 2/2005 |
| WO | WO2005082480 | 9/2005 |

* cited by examiner

FIG. 6

| Player | Player's Current Accumulated Bonus Sequence Eligibility Points | Total Outstanding Accumulated Bonus Sequence Eligibility Points | Player's Percentage of Winning Bonus Sequence |
|---|---|---|---|
| Player A | 4 | 10 | 40% |
| Player C | 3 | 10 | 30% |
| Player D | 1 | 10 | 10% |
| Player E | 2 | 10 | 20% |

FIG. 7

| Player | Number of Bonus Sequence Eligibility Points |
|---|---|
| A | 4 |
| B | 5 |
| C | 6 |

| Player | Number of Bonus Sequence Eligibility Points |
|---|---|
| A | 2 |
| B | 6 |
| C | 8 |

| Player | Number of Bonus Sequence Eligibility Points |
|---|---|
| A | 6 |
| B | 0 |
| C | 12 |

| Player | Number of Bonus Sequence Eligibility Points | Chances of Winning Bonus Sequence |
|---|---|---|
| A | 6 | 33% |
| B | 0 | 0% |
| C | 12 | 67% |

Progressive Award of MLP maintained for Player C:
1st Level Progressive Award: $120 (base value of $10 X 12 accumulated bonus sequence eligibility points)
2nd Level Progressive Award: $600 (base value of $50 X 12 accumulated bonus sequence eligibility points)
3rd Level Progressive Award: $1200 (base value of $100 X 12 accumulated bonus sequence eligibility points)
4th Level Progressive Award: $12,000 (base value of $1000 X 12 accumulated bonus sequence eligibility points)

Time

120

Player A forfeits 2 bonus sequence eligibility points - each bonus sequence eligibility point has a linked value of $200

Player A is provided $100 for two forfeited bonus sequence eligibility points

Bonus sequence award from previous bonus sequence: $2000

Bonus sequence award for next bonus sequence: $350 ($50 start-up value + $300 for Player A's two forfeited bonus sequence eligibility points)

122

Player B forfeits 6 bonus sequence eligibility points

Player B is provided $300 for six forfeited bonus sequence eligibility points

Bonus sequence award from previous bonus sequence: $2000

Bonus sequence award for next bonus sequence: $1250 ($50 start-up value + $300 for Player A's two forfeited bonus sequence eligibility points + $900 for Player B's six forfeited bonus sequence eligibility points)

124

Trigger of Bonus Sequence - Players A & C participate in bonus sequence

Player C wins bonus sequence and is provided Bonus sequence award of $2000 from previous bonus sequence Player A is provided $300 for six bonus sequence eligibility points accumulated by a player that participated in, but did not win the bonus sequence Bonus sequence award for next bonus sequence: $2150 ($50 start-up value + $300 for Player A's two forfeited bonus sequence eligibility points + $900 for Player B's six forfeited bonus sequence eligibility points + $900 for Player A's six bonus sequence eligibility points forfeited for participating in, but not winning the bonus sequence)

126

Player C participates in MLP event

Player C wins 2nd Level Progressive Award of $600

Bonus sequence award for next bonus sequence: $2150

GAMING SYSTEM, GAMING DEVICE AND METHOD FOR PROVIDING MULTI-LEVEL PROGRESSIVE AWARDS

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a wager to activate the primary or base game. In many of these gaming machines, the award is based on the player obtaining a winning symbol or symbol combination and on the amount of the wager (e.g., the higher the wager, the higher the award). Symbols or symbol combinations which are less likely to occur usually provide higher awards.

In such known gaming machines, the amount of the wager made on the base game by the player may vary. For instance, the gaming machine may enable the player to wager a minimum number of credits, such as one credit (e.g., one cent, nickel, dime, quarter or dollar) up to a maximum number of credits, such as five credits. This wager may be made by the player a single time or multiple times in a single play of the primary game. For instance, a slot game may have one or more paylines and the slot game may enable the player to make a wager on each payline in a single play of the primary game. Thus, it is known that a gaming machine, such as a slot game, may enable players to make wagers of substantially different amounts on each play of the primary or base game ranging, for example, from one credit up to 125 credits (e.g., five credits on each of 25 separate paylines). This is also true for other wagering games, such as video draw poker, where players can wager one or more credits on each hand and where multiple hands can be played simultaneously. Accordingly, it should be appreciated that different players play at substantially different wagering amounts or levels and at substantially different rates of play.

Secondary or bonus games are also known in gaming machines. The secondary or bonus games usually provide an additional award to the player. Secondary or bonus games usually do not require an additional wager by the player to be activated. Secondary or bonus games are generally activated or triggered upon an occurrence of a designated triggering symbol or triggering symbol combination in the primary or base game. For instance, a bonus symbol occurring on the payline on the third reel of a three reel slot machine may trigger the secondary bonus game. When a secondary or bonus game is triggered, the gaming machines generally indicates this to the player through one or more visual and/or audio output devices, such as the reels, lights, speakers, video screens, etc. Part of the enjoyment and excitement of playing certain gaming machines is the occurrence or triggering of the secondary or bonus game (even before the player knows how much the bonus award will be).

Progressive awards associated with gaming machines are also known. In one form, a progressive award is an award amount which includes an initial amount and an additional amount funded through a portion of each wager made on the progressive gaming machine. For example, 0.1% of each wager placed on the primary game of a gaming machine may be allocated to the progressive award or progressive award fund. The progressive award grows in value as more players play the gaming machine and more portions of the players' wagers are allocated to the progressive award. When a player obtains a winning symbol or symbol combination which results in the progressive award, the accumulated progressive award is provided to the player. After the progressive award is provided to the player, the amount of the next progressive award is reset to the initial value and a portion of each subsequent wager is allocated to the next progressive award.

A progressive award may be associated with a single gaming machine or multiple gaming machines which each contribute portions of the progressive award. The multiple gaming machines may be in the same bank of machines, in the same casino or gaming establishment (usually through a local area network ("LAN")) or in two or more different casinos or gaming establishments (usually through a wide area network ("WAN")). Such progressive awards are sometimes called local area progressives ("LAP") and wide area progressives ("WAP"), respectively.

Moreover, a gaming machine or bank of gaming machines may be simultaneously associated with a plurality of progressive awards. In these multi-level progressive ("MLP") configurations, a plurality of progressive awards start at different award or value levels, such as $10, $100, $1000 and $10,000 and each individually increment or increase until provided to a player. Upon a suitable triggering event at one of more of the gaming devices associated with the MLP, one or more of the progressive awards which form the MLP are provided to one or more of the players at such gaming devices.

While such progressive awards are popular amongst players, a number of issues exist, such as certain players feel they must wait a substantial period of time for the jackpot to climb to a high value. That is, when a progressive award is reset, such as after the progressive award is provided at a different gaming machine, a player may feel discouraged and not wish to continue playing for a base or reset level progressive award. Such discouragement can lead to certain players walking away with jackpot fatigue which occurs when a player no longer finds an award desirable or worth the cost of continuing to play.

There is a continuing need to provide new and different gaming machines and gaming systems as well as new and different ways to provide awards to players including progressive awards.

SUMMARY

In one embodiment, the gaming system and method disclosed herein provides and tracks bonus sequence eligibility points accumulated by players playing the gaming devices in the gaming system. In one embodiment, the gaming system maintains, for one or more players, a plurality of progressive awards arranged in a multi-level progressive (MLP) configuration. In this embodiment, for a specific player, one or more of the progressive awards is based, at least in part, on the quantity of accumulated bonus sequence eligibility points associated with or accumulated by that player.

In one embodiment, each accumulated bonus sequence eligibility point is associated with a value. In one such embodiment, if one of the players forfeits a bonus sequence eligibility point (due to player inactivity) or otherwise loses a bonus sequence eligibility point (due to not winning a provided bonus sequence), the gaming system contributes at least part of the value of such forfeited or lost bonus sequence eligibility points to increase a bonus sequence award maintained by the gaming system. Accordingly, in this embodiment, at least part of the value of one or more bonus sequence eligibility points are redistributed from the players that accumulated such bonus sequence eligibility points to a player that is provided the value of such bonus sequence eligibility points as part of a bonus sequence award.

In operation of one embodiment of the gaming system disclosed herein, if a bonus sequence triggering event occurs, such as after a designated time interval, the gaming system determines if any players are eligible to participate in the bonus sequence. In one such embodiment, a player is eligible to participate in the bonus sequence if the player has accumulated one or more bonus sequence eligibility points and retained such bonus sequence eligibility points (i.e., the player has not forfeited such bonus sequence eligibility points due to player inactivity or other conditions). If at least one player is determined eligible to participate in the bonus sequence, the gaming system enables such eligible players to participate in the bonus sequence wherein each eligible player's chance of winning the bonus sequence is based on that player's accumulated bonus sequence eligibility points relative to the total number of bonus sequence eligibility points accumulated by the eligible players participating in the bonus sequence. In this embodiment, the gaming system determines a winner of the bonus sequence and provides the determined winner the maintained bonus sequence award.

In addition to providing the winner of the bonus sequence a bonus sequence award, the gaming system further enables such a player to participate in an MLP bonus event. Based on one or more decisions or inputs by the player in the MLP bonus event, the gaming system provides the player one of the maintained progressive awards of the MLP. Accordingly, the gaming system and method disclosed herein provides that each player's progressive awards are based, at least in part, on a quantity of bonus sequence eligibility points accumulated (and retained) for that player. The gaming system and method disclosed herein further provides that a separate bonus sequence award provided to one of the players is based, at least in part, on the values associated with any forfeited bonus sequence eligibility points and/or the values associated with any bonus sequence eligibility points accumulated by any players that participated in, but did not win a bonus sequence.

In one embodiment, the gaming system disclosed herein includes a central server, central controller or remote host in communication with or linked to a plurality of gaming machines or gaming devices. In one such embodiment, the gaming system enables a player to place a bonus sequence wager for a play of a game, wherein the bonus sequence wager is in addition to any wagers placed on the game (i.e., any non-bonus sequence wagers). In this embodiment, if the player places the bonus sequence wager and a designated symbol or designated symbol combination is generated for the play of the game, the gaming system provides the player one or more bonus sequence eligibility points. In one such embodiment, the quantity of bonus sequence eligibility points provided to (i.e., accumulated by) the player is based on the non-bonus sequence wager placed on the game. For example, if a first player places a first wager on a game (in addition to a bonus sequence wager) and a designated symbol or symbol combination is generated in the play of the game, the gaming system provides the first player a first quantity of bonus sequence eligibility points. In this example, if a second player places a second, greater wager on a game (in addition to a bonus sequence wager) and the designated symbol or symbol combination is generated in the play of the game, the gaming system provides the second player a second, greater quantity of bonus sequence eligibility points. In another embodiment, one or more bonus sequence eligibility points are provided based on a displayed event in a play of one or more displayed games of one or more of the gaming devices in the gaming system. In another embodiment, one or more bonus sequence eligibility points are provided independent of any displayed event in any play of any game of any of the gaming devices in the gaming system.

In one embodiment, if a player is inactive for a designated period of time after accumulating one or more bonus sequence eligibility points, the player forfeits one or more of the player's accumulated bonus sequence eligibility points. That is, if the gaming system determines a gaming device's status as inactive, the gaming system causes one or more of the accumulated bonus sequence eligibility points to be forfeited. In other words, the gaming system causes a player to forfeit the right to obtain the value associated with one or more of that player's accumulated bonus sequence eligibility points. In one such embodiment, a gaming device (or a player currently at the gaming device) is active if the gaming device is being actively played by a player, such as the player placing one or more wagers on the primary game of the gaming device during a designated time period. In this embodiment, a gaming device (or a player currently at the gaming device) is inactive if the gaming device is not in the active status (i.e., not being actively played by a player according to one or more of the predetermined criteria) during the designated time period.

In one embodiment, if a player forfeits a bonus sequence eligibility point, the gaming system (i) provides to a player a portion of a linked, inherent or escrowed value of the forfeited bonus sequence eligibility point, and (ii) contributes another portion of the linked, inherent or escrowed value of the forfeited bonus sequence eligibility point to a bonus sequence award. In one embodiment, this linked value or amount is equal to or substantially equal to the average expected payout of the MLP event described below. It should be appreciated that even though each bonus sequence eligibility point is associated with a linked value, such a linked value will not necessarily be provided to the player which accumulated the bonus sequence eligibility point. That is, the gaming system utilizes at least part of the value associated with one or more bonus sequence eligibility points to fund a bonus sequence award which may be provided to a player different than the player that accumulated such bonus sequence eligibility points.

In one embodiment, as described below, the bonus sequence award is provided to the determined winning player of the bonus sequence (or the determined winning player of a subsequently provided bonus sequence). Thus, the gaming system disclosed herein provides that even if a bonus sequence eligibility point is forfeited, the linked value of that bonus sequence eligibility point is still provided to one of the players at one of the gaming devices in the gaming system. For example, if a player forfeits a bonus eligibility point with a linked value of 1000 credits, 300 credits are provided to the player and 700 credits fund a bonus sequence award as described below. In another embodiment, if a player forfeits a bonus sequence eligibility point, the entire linked value of the forfeited bonus sequence eligibility point is contributed to a bonus sequence award as described below.

In one embodiment, in addition to tracking bonus sequence eligibility points for one or more players at one or more gaming devices in the gaming system, the gaming system maintains, for each of a plurality of players at the gaming devices in the gaming system, a plurality of progressive awards arranged in an MLP configuration. In one embodiment, for each player, the value of one or more of these progressive awards is based at least in part on a quantity of that player's accumulated bonus sequence eligibility points and a start-up or reset amount for that progressive award. In this embodiment, such progressive awards for each player are further funded by an increment value which is determined by allocating a percentage of each player's coin-in or wagered amounts to one or more of the progressive awards of the MLP. For example, if a first progressive award of an MLP for a first player is associated with a start-up amount of $100, the first player is currently associated with one accumulated bonus sequence eligibility point and the progressive award has incremented $20 (based on the wagers placed at the gaming devices in the gaming system), the first progressive award for the first player is currently valued at $220 (or ($100×2)+$20). In another example, if a first progressive award of an MLP for a second player is associated with a start-up amount of $100, the second player is currently associated with three accumulated bonus sequence eligibility points and the progressive award has incremented $20 (based on the wagers placed at the gaming devices in the gaming system), the first progressive award for the second player is currently valued at $420 (or ($100×4)+$20). Continuing with this example, another player is currently associated with zero accumulated bonus sequence eligibility points and the progressive award has incremented $20 (based on the wagers placed at the gaming devices in the gaming system), the first progressive award for the other player is currently valued at $120 (or ($100×1)+$20). It should be appreciated that as accumulated bonus sequence eligibility points are accumulated, as accumulated bonus sequence eligibility points are forfeited and as the value of one or more progressive awards are based on a player's quantity of pending bonus sequence eligibility points, the value of such progressive awards for each player are dynamic and frequently fluctuate in value.

In one embodiment, the gaming system maintains the progressive awards and provides bonus sequence eligibility points until a bonus sequence triggering event occurs. In one such embodiment, the bonus sequence triggering event occurs based on an elapsed period of time, such as eight minutes since the last occurrence of a bonus sequence triggering event. In another such embodiment, the bonus sequence triggering event occurs based on a displayed event in a play of one or more games (or an accumulation of one or more displayed events in one or more plays of one or more games) of one or more of the gaming devices in the gaming system. In another such embodiment, the bonus sequence triggering event occurs independent of any displayed event in any play of any game of any of the gaming devices in the gaming system.

In one embodiment, if the bonus sequence triggering event occurs, the gaming system determines if any players are eligible to participate in the bonus sequence. In one such embodiment, a player is eligible to participate in the bonus sequence if the player has accumulated one or more bonus sequence eligibility points and retained such bonus sequence eligibility points (i.e., the bonus sequence eligibility points have not lapsed or expired). For example, if a first player is provided one bonus sequence eligibility point, a second player is provided three bonus sequence eligibility points, the first player has remained actively playing a gaming device in the gaming system (and thus retained their one bonus sequence eligibility point) and the second player has not remained actively playing a gaming device in the gaming system (and thus forfeited their three bonus sequence eligibility points), the gaming system determines that the first player is eligible to participate in the bonus sequence and the second player is ineligible to participate in the bonus sequence.

In one embodiment, if the gaming system determines that no players are eligible to participate in the bonus sequence, the gaming system continues maintaining the progressive awards and providing bonus sequence eligibility points until another bonus sequence triggering event occurs. On the other hand, if the gaming system determines that at least one player is eligible to participate in the bonus sequence, the gaming system enables such eligible player(s) to participate in the bonus sequence. In one such embodiment, the bonus sequence includes a competition game wherein each eligible player's chance of winning the bonus sequence is based on that player's accumulated bonus sequence eligibility points relative to the total number of bonus sequence eligibility points accumulated by the eligible players participating in the bonus sequence. Utilizing the example described above, if the first player with one bonus sequence eligibility point and a third player with five bonus sequence eligibility points each participate in the bonus sequence and a total of ten bonus sequence eligibility points are accumulated by the eligible players in the bonus sequence, then the first player has a 10% (or 1/10) chance of winning the bonus sequence and the third player has a 50% (or 5/10) chance of winning the bonus sequence.

In one embodiment, based on these determined probabilities for each player, the gaming system determines a player to win the bonus sequence and zero, one or more players to not win or lose the bonus sequence.

In one embodiment, for each of any players that participated in, but did not win, the bonus sequence, the gaming system provides such players a consolation award. In one such embodiment, the consolation award provided to each player is based on a portion of the linked value of that player's accumulated bonus sequence eligibility points. In this embodiment, the remaining portion of the linked value of that player's bonus sequence eligibility points is contributed to the bonus sequence award as described below. For example, if the first player described above with one bonus sequence eligibility point (with a linked value of 1000 credits) participates in, but does not win the bonus sequence, 300 credits are provided to the first player as a consolation award and 700 credits fund the bonus sequence award to be subsequently provided. In another example, if another player with three bonus sequence eligibility points (with a linked value of 1000 credits for each bonus sequence eligibility point) participates in, but does not win the bonus sequence, 900 (or 300×3) credits are provided to the player as a consolation award and 2100 (or 700×3) credits fund the bonus sequence award to be subsequently provided.

In one embodiment, the gaming system provides the determined winning player of the bonus sequence with a bonus sequence award. In one such embodiment, as described above, the bonus sequence award is based, at least in part, on a portion of the linked value of each bonus sequence eligibility point accumulated by a player that participated in but did not win the bonus sequence (or a previous bonus sequence). In various embodiments, the bonus sequence award is further or alternatively based, at least in part, on part or all of the linked value of each bonus sequence eligibility point forfeited by a player for inactivity. In various embodiments, the bonus sequence award is further or alternatively based, at least in part, on a start-up value or amount associated with the bonus sequence award.

In one embodiment, the bonus sequence award provided to the player of the current bonus sequence is determined based on one or more events which occurred in association with a previous bonus sequence. That is, the formed bonus sequence award is based, at least in part, on each bonus sequence eligibility point that is forfeited in association with a previous bonus sequence and each bonus sequence eligibility point held by a player that did not win the previous bonus sequence. This embodiment provides that a player's activity (or inactivity) associated with a first bonus sequence and/or one or more outcomes determined in a first bonus sequence determine, at least in part, a bonus sequence award for a winning player of a second bonus sequence. In another example, the winner of the next bonus sequence is provided a bonus sequence award of 3000 credits (or the 2100 credits applied to the bonus sequence award for the second player's three forfeited bonus sequence eligibility points (700 credits per bonus sequence eligibility point×3), the 700 credits applied to the bonus sequence award for the one bonus sequence eligibility point accumulated by the first player that participated in, but did not win the bonus sequence, and a 200 credits bonus sequence award start-up value).

In one embodiment, in addition to providing the winner of the bonus sequence with the above-described bonus sequence award, the gaming system enables the winner of the bonus sequence to participate in a further MLP bonus event. In one embodiment, the MLP bonus event includes enabling the player to make one or more inputs or decisions for one or more rounds or levels, wherein the result of such inputs determines which of the progressive awards of the MLP maintained for that player to provide to the player. In one such embodiment, the gaming system displays the player's success or failure for one or more player inputs in the MLP bonus event as the deterioration of one or more images. In one embodiment, the MLP bonus event includes a plurality of levels, wherein each level is associated one of the progressive awards. In this embodiment, a player begins playing the MLP bonus event at a first or default level associated with a first of the progressive awards maintained for that player. If the player is unsuccessful with one or more inputs at their current level (in this case the first level), the gaming system provides the player the progressive award associated with their current level and the MLP bonus event ends. If the player successfully completes the current level, the player advances to any subsequent level and plays for the progressive award associated with that level. This advancement proceeds until the player is unsuccessful with their current level (and wins the progressive award of that level) or the player successfully completes the top level (and wins the top level progressive award of the MLP).

Accordingly, an advantage of the gaming system and method disclosed herein is to provide a gaming system and method which enables a player to accumulate bonus sequence eligibility points that determine both a value of one or more progressive awards maintained for that player and that player's relative probability of winning a bonus sequence.

Another advantage of the gaming system and method disclosed herein is that the gaming system stores one or more triggers of a bonus event until a subsequent time in which part or all of the stored payouts of the triggered bonus events are provided to a player. That is, if each bonus sequence eligibility point is associated with a linked value equal to or substantially equal to the average expected payout of the MLP event, in one embodiment, each bonus sequence eligibility point is equivalent to a stored trigger of the MLP event. In other words, the gaming system disclosed herein provides one or more triggers of an MLP event, wherein displaying such MLP events (and providing an award for such MLP events) is delayed until a subsequent time.

Additional features and advantages are described in, and will be apparent from, the following Detailed Description and the figures.

BRIEF DESCRIPTION OF THE FIGURES

FIG. 6 is a chart of an example of the accumulated bonus sequence eligibility points for a plurality of players and each player's relative probability of winning the bonus sequence based on these accumulated bonus sequence eligibility points.

FIG. 7 is a timeline illustrating an example with a plurality of players accumulating and forfeiting bonus sequence eligibility points, one of the players winning a bonus sequence award, and one of the progressive awards of the MLP maintained for that player.

DETAILED DESCRIPTION

The present disclosure may be implemented in various configurations for gaming machines, gaming devices or gaming systems, including but not limited to: (1) a dedicated gaming machine, gaming device or gaming system wherein the computerized instructions for controlling any games (which are provided by the gaming machine or gaming device) are provided with the gaming machine or gaming device prior to delivery to a gaming establishment; and (2) a changeable gaming machine, gaming device or gaming system where the computerized instructions for controlling any games (which are provided by the gaming machine or gaming device) are downloadable to the gaming machine or gaming device through a data network when the gaming machine or gaming device is in a gaming establishment. In one embodiment, the computerized instructions for controlling any games are executed by at least one central server, central controller or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
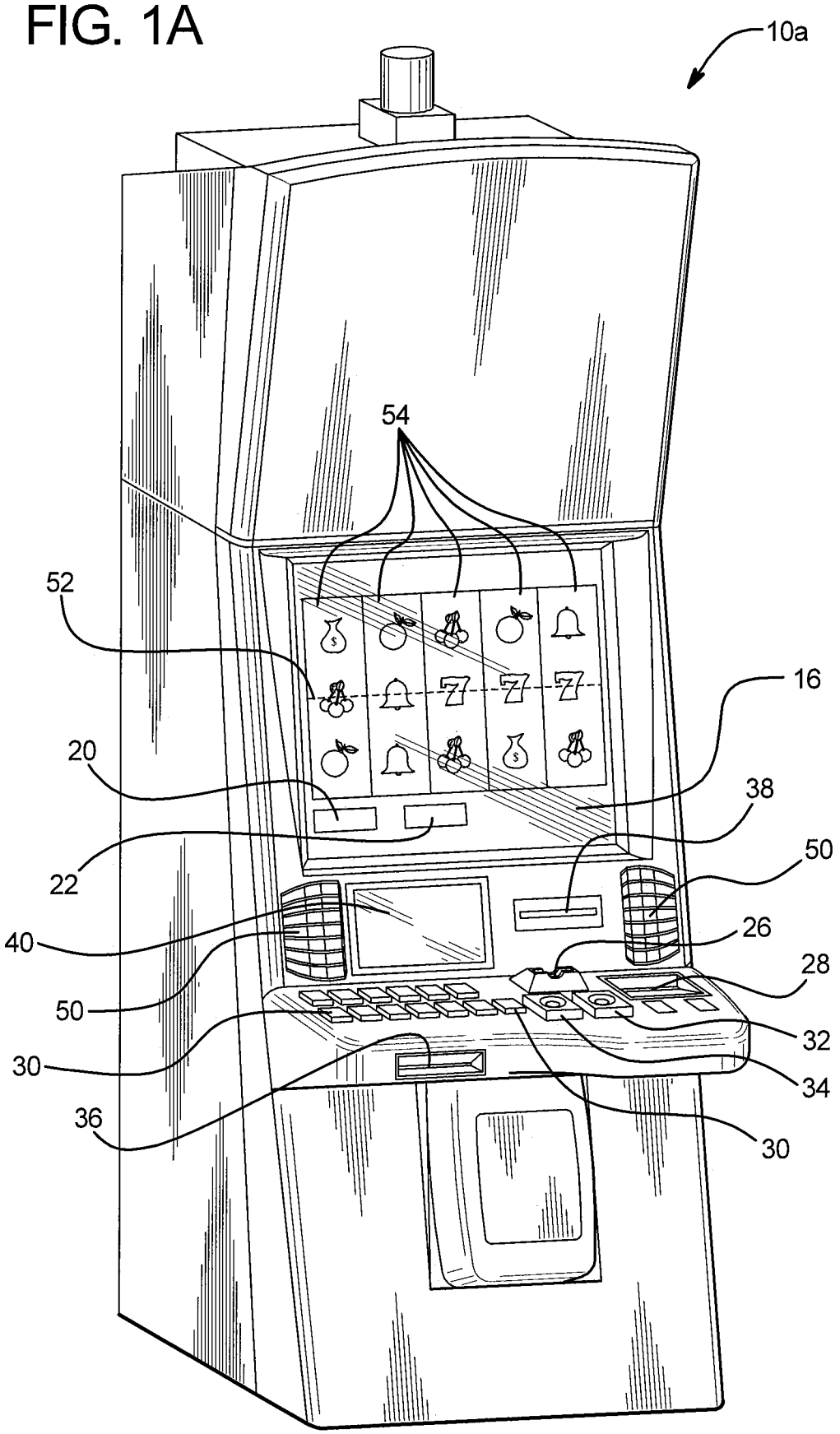
FIG. 1A is a front-side perspective view of one embodiment of the gaming device disclosed herein.
Figure 1B:
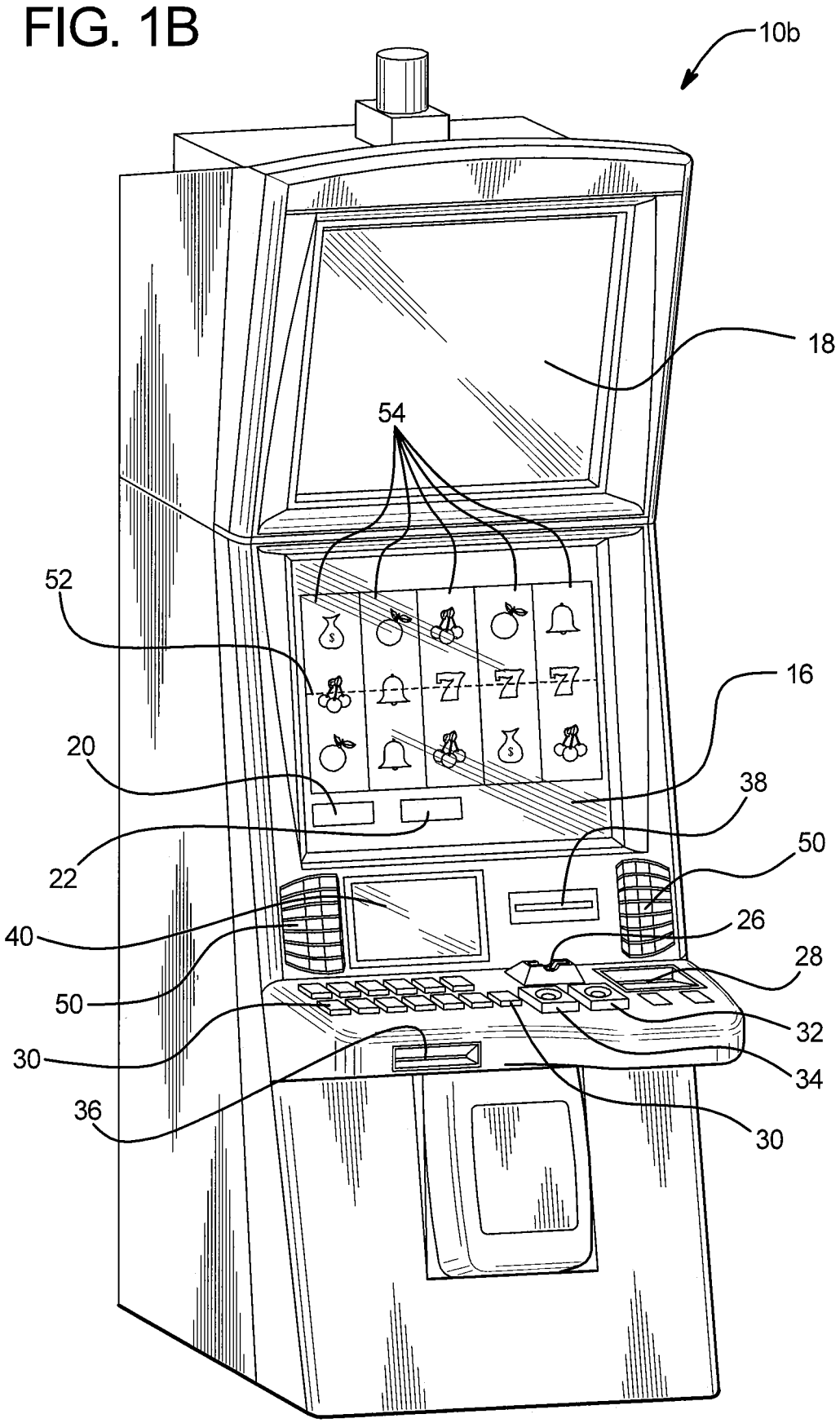
FIG. 1B is a front-side perspective view of another embodiment of the gaming device disclosed herein.

Referring now to the drawings, two example alternative embodiments of the gaming device disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing or cabinet which provides support for a plurality of displays, inputs, controls and other features of a conventional gaming machine. It is configured so that a player can operate it while standing or sitting. The gaming device may be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
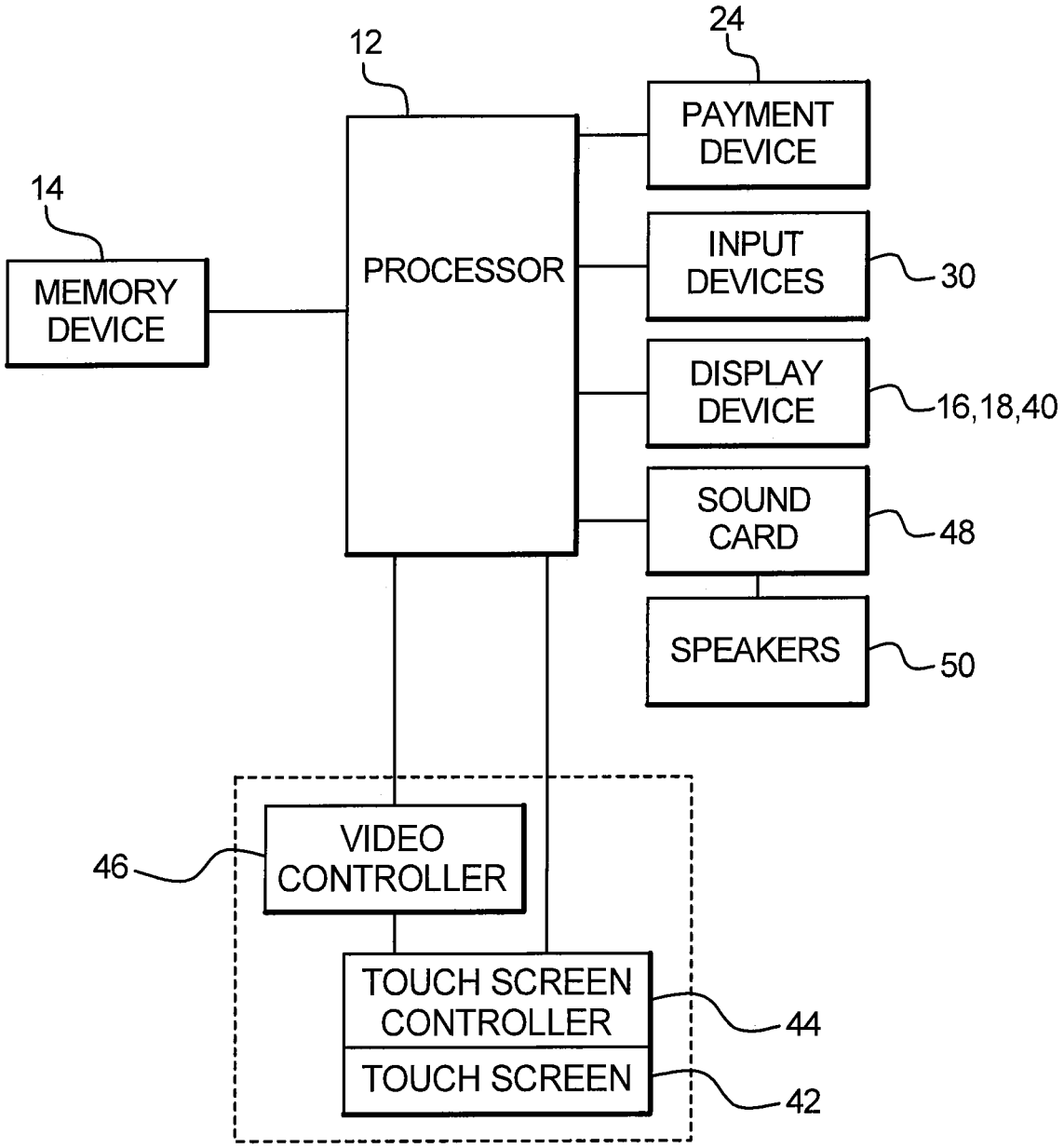
FIG. 2A is a schematic block diagram of the electronic configuration of one embodiment of the gaming device disclosed herein.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information and applicable game rules that relate to the play of the gaming device. In one embodiment, the memory device includes random access memory (RAM), which can include non-volatile RAM (NVRAM), magnetic RAM (MRAM), ferroelectric RAM (FeRAM) and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD or USB memory device. In other embodiments, part or all of the program code and/or operating data described above can be downloaded to the memory device through a suitable network.

In one embodiment, an operator or a player can use such a removable memory device in a desktop computer, a laptop personal computer, a personal digital assistant (PDA), portable computing device, or other computerized platform to implement the present disclosure. In one embodiment, the gaming device or gaming machine disclosed herein is operable over a wireless network, such as part of a wireless gaming system. In this embodiment, the gaming machine may be a hand held device, a mobile device or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In another embodiment, as discussed below, upon a player initiating game play at the gaming device, the gaming device enrolls in a bingo game. In this embodiment, a bingo server calls the bingo balls that result in a specific bingo game outcome. The resultant game outcome is communicated to the individual gaming device to be provided to a player. In one embodiment, this bingo outcome is displayed to the player as a bingo game and/or in any form in accordance with the present disclosure.

In one embodiment, as illustrated in FIG. 2A, the gaming device includes one or more display devices controlled by the processor. The display devices are preferably connected to or mounted to the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance or the equivalent. In one embodiment, the gaming device includes a bet display 22 which displays a player's amount wagered. In one embodiment, as described in more detail below, the gaming device includes a player tracking display 40 which displays information regarding a player's playing tracking status.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LED), a display based on a plurality of organic light-emitting diodes (OLEDs), a display based on polymer light-emitting diodes (PLEDs), a display based on a plurality of surface-conduction electron-emitters (SEDs), a display including a projected and/or reflected image or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual or video reels and wheels, dynamic lighting, video images, images of people, characters, places, things and faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels or dice, configured to display at least one or a plurality of game or other suitable images, symbols or indicia.

As illustrated in FIG. 2A, in one embodiment, the gaming device includes at least one payment device 24 in communication with the processor. As seen in FIGS. 1A and 1B, a payment device such as a payment acceptor includes a note, ticket or bill acceptor 28 wherein the player inserts paper money, a ticket or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals (or related data) and other relevant information. In another embodiment, a player may carry a portable device, such as a cell phone, a radio frequency identification tag or any other suitable wireless device, which communicates a player's identification, credit totals (or related data) and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a play button 32 or a pull arm (not shown) which is used by the player to start any primary game or sequence of events in the gaming device. The play button can be any suitable play activator such as a bet one button, a max bet button or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card may be implemented in accordance with the gaming device disclosed herein.

In one embodiment, as mentioned above and seen in FIG. 2A, one input device is a touch-screen 42 coupled with a touch-screen controller 44, or some other touch-sensitive display overlay to allow for player interaction with the images on the display. The touch-screen and the touch-screen controller are connected to a video controller 46. A player can make decisions and input signals into the gaming device by touching the touch-screen at the appropriate places. One such input device is a conventional touch-screen button panel.

The gaming device may further include a plurality of communication ports for enabling communication of the processor with external peripherals, such as external video sources, expansion buses, game or other displays, an SCSI port or a key pad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as playing music for the primary and/or secondary game or for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized for or to provide any appropriate information.

In one embodiment, the gaming machine may include a sensor, such as a camera in communication with the processor (and possibly controlled by the processor) that is selectively positioned to acquire an image of a player actively using the gaming device and/or the surrounding area of the gaming device. In one embodiment, the camera may be configured to selectively acquire still or moving (e.g., video) images and may be configured to acquire the images in either an analog, digital or other suitable format. The display devices may be configured to display the image acquired by the camera as well as display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering primary or base game. The gaming machine or device may include some or all of the features of conventional gaming machines or devices. The primary or base game may comprise any suitable reel-type game, card game, cascading or falling symbol game, number game or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented.

In one embodiment, as illustrated in FIGS. 1A and 1B, a base or primary game may be a slot game with one or more paylines 52. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, display the plurality of simulated video reels 54. Each reel 54 displays a plurality of indicia or symbols, such as bells, hearts, fruits, numbers, letters, bars or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device with wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels, modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more or each of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel).

In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to being based on how many paylines that would have passed through each of the strings of related symbols in active symbol positions).

In one embodiment, a base or primary game may be a poker game wherein the gaming device enables the player to play a conventional game of video draw poker and initially deals five cards all face up from a virtual deck of fifty-two card deck. Cards may be dealt as in a traditional game of cards or in the case of the gaming device, may also include that the cards are randomly selected from a predetermined number of cards. If the player wishes to draw, the player selects the cards to hold via one or more input device, such as pressing related hold buttons or via the touch screen. The player then presses the deal button and the unwanted or discarded cards are removed from the display and the gaming machine deals the replacement cards from the remaining cards in the deck. This results in a final five-card hand. The gaming device compares the final five-card hand to a payout table which utilizes conventional poker hand rankings to determine the winning hands. The gaming device provides the player with an award based on a winning hand and the credits the player wagered.

In another embodiment, the base or primary game may be a multi-hand version of video poker. In this embodiment, the gaming device deals the player at least two hands of cards. In one such embodiment, the cards are the same cards. In one embodiment each hand of cards is associated with its own deck of cards. The player chooses the cards to hold in a primary hand. The held cards in the primary hand are also held in the other hands of cards. The remaining non-held cards are removed from each hand displayed and for each hand replacement cards are randomly dealt into that hand. Since the replacement cards are randomly dealt independently for each hand, the replacement cards for each hand will usually be different. The poker hand rankings are then determined hand by hand and awards are provided to the player.

In one embodiment, a base or primary game may be a keno game wherein the gaming device displays a plurality of selectable indicia or numbers on at least one of the display devices. In this embodiment, the player selects at least one or a plurality of the selectable indicia or numbers via an input device such as the touch screen. The gaming device then displays a series of drawn numbers to determine an amount of matches, if any, between the player's selected numbers and the gaming device's drawn numbers. The player is provided an award based on the amount of matches, if any, based on the amount of determined matches and the number of numbers drawn.

In one embodiment, in addition to winning credits or other awards in a base or primary game, the gaming device may also give players the opportunity to win credits in a bonus or secondary game or bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition may be by exceeding a certain amount of game play (such as number of games, number of credits, amount of time), or reaching a specified number of points earned during game play.

In another embodiment, the gaming device processor 12 or central server 56 randomly provides the player one or more plays of one or more secondary games. In one such embodiment, the gaming device does not provide any apparent reasons to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy in for a bonus game need be employed. That is, a player may not purchase an entry into a bonus game, rather they must win or earn entry through play of the primary game thus, encouraging play of the primary game. In another embodiment, qualification of the bonus or secondary game is accomplished through a simple "buy in" by the player, for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
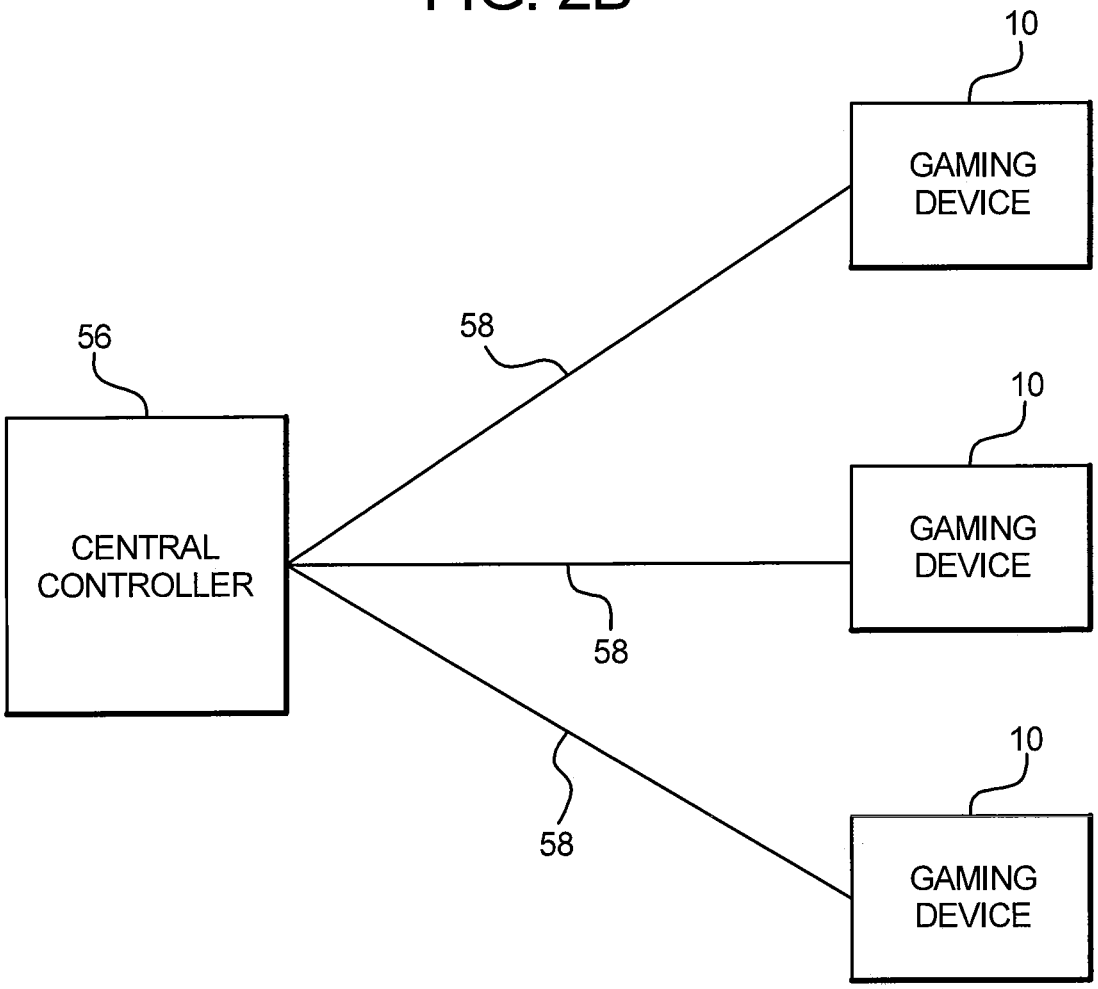
FIG. 2B is a schematic block diagram illustrating a plurality of gaming terminals in communication with a central controller.

In one embodiment, as illustrated in FIG. 2B, one or more of the gaming devices 10 are in communication with each other and/or at least one central server, central controller or remote host 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands or any other suitable data or signal between the individual gaming device and the central server. The gaming device processor is operable to execute such communicated events, messages or commands in conjunction with the operation of the gaming device. Moreover, the processor of the central server is designed to transmit and receive events, messages, commands or any other suitable data or signal between the central server and each of the individual gaming devices. The central server processor is operable to execute such communicated events, messages or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

In one embodiment, the game outcome provided to the player is determined by a central server or controller and provided to the player at the gaming device. In this embodiment, each of a plurality of such gaming devices are in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility and the like.

In another embodiment, a predetermined game outcome value is determined for each of a plurality of linked or networked gaming devices based on the results of a bingo, keno or lottery game. In this embodiment, each individual gaming device utilizes one or more bingo, keno or lottery games to determine the predetermined game outcome value provided to the player for the interactive game played at that gaming device. In one embodiment, the bingo, keno or lottery game is displayed to the player. In another embodiment, the bingo, keno or lottery game is not displayed to the player, but the results of the bingo, keno or lottery game determine the predetermined game outcome value for the primary or secondary game.

In the various bingo embodiments, as each gaming device is enrolled in the bingo game, such as upon an appropriate wager or engaging an input device, the enrolled gaming device is provided or associated with a different bingo card. Each bingo card consists of a matrix or array of elements, wherein each element is designated with a separate indicia, such as a number. It should be appreciated that each different bingo card includes a different combination of elements. For example, if four bingo cards are provided to four enrolled gaming devices, the same element may be present on all four of the bingo cards while another element may solely be present on one of the bingo cards.

In operation of these embodiments, upon providing or associating a different bingo card to each of a plurality of enrolled gaming devices, the central controller randomly selects or draws, one at a time, a plurality of the elements. As each element is selected, a determination is made for each gaming device as to whether the selected element is present on the bingo card provided to that enrolled gaming device. This determination can be made by the central controller, the gaming device, a combination of the two, or in any other suitable manner. If the selected element is present on the bingo card provided to that enrolled gaming device, that selected element on the provided bingo card is marked or flagged. This process of selecting elements and marking any selected elements on the provided bingo cards continues until one or more predetermined patterns are marked on one or more of the provided bingo cards. It should be appreciated that in one embodiment, the gaming device requires the player to engage a daub button (not shown) to initiate the process of the gaming device marking or flagging any selected elements.

After one or more predetermined patterns are marked on one or more of the provided bingo cards, a game outcome is determined for each of the enrolled gaming devices based, at least in part, on the selected elements on the provided bingo cards. As described above, the game outcome determined for each gaming device enrolled in the bingo game is utilized by that gaming device to determine the predetermined game outcome provided to the player. For example, a first gaming device to have selected elements marked in a predetermined pattern is provided a first outcome of win $10 which will be provided to a first player regardless of how the first player plays in a first game and a second gaming device to have selected elements marked in a different predetermined pattern is provided a second outcome of win $2 which will be provided to a second player regardless of how the second player plays a second game. It should be appreciated that as the process of marking selected elements continues until one or more predetermined patterns are marked, this embodiment ensures that at least one bingo card will win the bingo game and thus at least one enrolled gaming device will provide a predetermined winning game outcome to a player. It should be appreciated that other suitable methods for selecting or determining one or more predetermined game outcomes may be employed.

In one example of the above-described embodiment, the predetermined game outcome may be based on a supplemental award in addition to any award provided for winning the bingo game as described above. In this embodiment, if one or more elements are marked in supplemental patterns within a designated number of drawn elements, a supplemental or intermittent award or value associated with the marked supplemental pattern is provided to the player as part of the predetermined game outcome. For example, if the four corners of a bingo card are marked within the first twenty selected elements, a supplemental award of $10 is provided to the player as part of the predetermined game outcome. It should be appreciated that in this embodiment, the player of a gaming device may be provided a supplemental or intermittent award regardless of if the enrolled gaming device's provided bingo card wins or does not win the bingo game as described above.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices.

In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any players gaming activity at the gaming device. In one such embodiment, the gaming device includes at least one card reader 38 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts and/or the time these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to each other.

In another embodiment, the gaming system disclosed herein is implemented via a data network, such as an internet or intranet. In one such embodiment, the operation of a gaming device can be viewed at the gaming device with at least one internet browser. In another such embodiment, the operation of a gaming device can be viewed at a location remote from the gaming device or gaming establishment utilizing at least one internet browser. In these embodiments, operation of the gaming device may be accomplished with only a connection to the central server or controller (i.e., an internet/intranet server) through a conventional phone or other data transmission line, digital subscriber line (DSL), T-1 line, coaxial cable, fiber optic cable, or other suitable connection. Accordingly, players may access an internet game page from any location where an internet connection and computer, or other internet facilitator is available. It should be appreciated that the expansion in the number of computers and number and speed of internet connections in recent years increases opportunities for players to play from an ever-increasing number of remote sites. It should be further appreciated that enhanced bandwidth of digital wireless communications may render such technology suitable for some or all communications, particularly if such communications are encrypted. Higher data transmission speeds may be useful for enhancing the sophistication and response of the display and interaction with the player.

In one embodiment, the central server (i.e., an internet/intranet server) maintains at least one dedicated gaming site which is associated with one or more progressive awards and one or more supplemental funds as disclosed herein. In operation, a player logs onto the dedicated gaming site and the central server enables the player to wager on and participate in one or more online games at this gaming site. In this embodiment, upon the occurrence of any progressive award increase event, the central server adds a value or amount (from the maintained supplemental fund) to one or more of the progressive awards associated with the dedicated gaming site.

In one embodiment, to regulate and monitor the play of games over the internet, player's identifications are verified through credit card authentication. Through this authentication, the gaming system verifies the player, the player's age, the player's location and any other suitable information associated with the player. In one such embodiment, the gaming system utilizes the verified location information to monitor and ensure that the player in a certain location follows any applicable gaming regulations associated with that location. In another such embodiment, the gaming system utilizes the verified location information to set up different progressive awards for different regions. In this embodiment, different progressive awards are allotted per region.

In another embodiment including game play over the internet, the gaming system stores information about one or more players. In this embodiment, after a player has enrolled or identified themselves with the gaming system (via the dedicated gaming site), the gaming system stores their information, such as credit card information, preferred options, player number, name, or any other information in a database. In one such embodiment, the gaming system enables the player to set and store one or more gaming options, such as jackpot betting, side wagering, and preferred games, associated with the dedicated gaming site.

As mentioned above, in one embodiment, the present disclosure may be employed in a server based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to or fixed on the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, downloading or streaming the game program over a dedicated data network, internet or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In one embodiment, in addition to the progressive awards with values that are based, at least in part, on zero, one or more bonus sequence eligibility points as described below, a plurality of gaming devices at one or more gaming sites are networked to the central server in a progressive configuration, wherein a portion of each wager placed is allocated to one or more progressive awards. In one embodiment, such progressive awards are associated with the system of gaming machines which each contribute portions of the progressive awards. In one such embodiment, different progressive awards are associated with different numbers of gaming devices. For example, a progressive award valued at $10,000 may be associated with ten gaming devices while another progressive award valued at $500,000 may be associated with one-hundred gaming devices. In one embodiment, the multiple gaming machines may be in the same bank of machines, in the same casino or gaming establishment such as through a LAN or in two or more different casinos or gaming establishments such as through a WAN. In another embodiment, each individual gaming machine maintains one or more progressive awards wherein a portion of each wager placed at that respective gaming machine is allocated to one or more progressive awards maintained by such individual gaming machine. In another embodiment, each individual gaming machine maintains one or more progressive awards and the central server simultaneously or substantially simultaneously maintains one or more progressive awards. In one such embodiment, the lower valued, more frequently triggered progressive awards are maintained by the individual gaming machines and the higher valued, less frequently triggered progressive awards are maintained by the central server.

In one embodiment, a host site computer is coupled to a plurality of the central servers at a variety of mutually remote gaming sites for providing a multi-site linked progressive automated gaming system. In one embodiment, a host site computer may serve gaming devices distributed throughout a number of properties at different geographical locations including, for example, different locations within a city or different cities within a state. In one embodiment, the host site computer is maintained for the overall operation and control of the system. In this embodiment, a host site computer oversees all or part of the progressive gaming system and is the master for computing all or part of the progressive jackpots. All participating gaming sites report to, and receive information from, the host site computer. Each central server computer is responsible for all data communication between the gaming device hardware and software and the host site computer.

In one embodiment, more than one of the progressive awards start at the same level, such as $1000 and increment or increase until provided to a player. In another embodiment, more than one of the progressive awards start at different levels such as $10, $100, $1000 and $10,000 and increment or increase until provided to a player. The progressive awards accumulate based on a small percentage (such as 0.1%) of coin-in or wagered amounts in a conventional manner. In one embodiment, the percentage that goes to each progressive award is equal (such as 0.1% to each of four progressive awards). At this accrual rate, player wagers totaling $1,000,000 are required for the progressive to reach $1000. In one embodiment, at least a fraction of this amount may be funded by the casino by using a starting value higher than zero to make the progressive awards attractive even after they are reset. In other embodiments, two or more of the progressive awards may be funded by different percentages. In these embodiments, the central server and/or individual gaming device processor continues to increase the progressive levels until a progressive award is provided to a player (upon the occurrence of a progressive award triggering event), at which point the progressive is reset and another progressive award starts incrementing from the appropriate default progressive award level. In another embodiment, one or more progressive awards increment a predetermined amount per game played. In one such embodiment, this incremental amount is partially funded by an amount of the wagers placed and is partially funded by an amount provided by a gaming establishment marketing or advertisement department. In different embodiments, the gaming establishment marketing or advertisement department provides a value or amount to the progressive award based on matching a percentage of wagers placed, a predetermined amount for each game played, an elapsed period of time, or any other suitable manner.

In another embodiment, two or more of the progressive awards may be funded at different temporal rates. In this embodiment, the different progressive awards are incremented or funded in different increments of time wherein until the progressive hits, a set amount is added to the progressive at each determined time increment. In another embodiment, two or more of the progressive awards may each be incremented or funded based on different incrementing factors or incrementors. In this embodiment, a first of the progressive awards may increment each time a first incrementing factor occurs and a second of the progressive awards may increment each time a second incrementing factor occurs, wherein the first incrementing factor and the second incrementing factor are different. Examples of incrementing factors could be a symbol-driven trigger in the base game, the player betting a maximum amount, a percentage of possible gaming machines being actively played or in active status, or any other suitable method for defining an incrementor.

In one embodiment, one or more of the progressive awards are funded, at least partially, via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed. In another embodiment, one or more progressive awards are funded, at least partially, via an amount provided by one or more marketing and/or advertising departments, such as a casino's marketing department.

In one alternative embodiment, a minimum wager level is required for a gaming machine to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

In one embodiment, the central server or other central controller determines when one or more progressive award wins are triggered. In this embodiment, a central controller and an individual gaming machine work in conjunction with each other to determine when a progressive award win is triggered, for example through an individual gaming machine meeting a predetermined requirement or criteria established by the central controller. In another embodiment, an individual gaming machine may determine when one or more progressive award wins are triggered. In another embodiment, an individual gaming machine may determine when at least one progressive award win is triggered and the central controller determines when at least one progressive award win is triggered.

In one embodiment, different gaming devices in the gaming system have different progressive awards available to a player. In one such embodiment, different types of gaming devices are associated with different types of progressive awards based on the current configuration of the gaming system. In one embodiment, zero, one or more progressive awards may be associated with each of the gaming devices in the gaming system while zero, one or more different progressive awards may be associated with a plurality of, but not all of the gaming devices in the gaming system.

In one embodiment, at least one and preferably a plurality of the progressive awards maintained by the gaming system are provided to players of the linked gaming machines in an apparently random fashion as perceived by the players of these gaming machines. These progressive awards are distinguished from the awards that the gaming machines provide to the players for displayed winning outcomes in the plays of the primary wagering games, such as slot games, card games (e.g., poker, blackjack) or any other suitable game.

In one embodiment, the gaming devices do not provide any apparent reasons to the players for obtaining such progressive awards. In this embodiment, providing the progressive awards is not triggered by a displayed event in the primary game or based specifically on any of the displayed plays of any primary game or on any of the displayed plays of any secondary game of the gaming machines in the system. That is, these progressive awards are provided to the players without any explanation or alternatively with simple explanations.

In another embodiment, a plurality of players at a plurality of linked gaming devices in a gaming system participate in a group gaming environment. In one embodiment, a plurality of players at a plurality of linked gaming devices work in conjunction with one another, such as playing together as a team or group, to win one or more awards. In one such embodiment, any award won by the group is shared, either equally or based on any suitable criteria, amongst the different players of the group. In another embodiment, a plurality of players at a plurality of linked gaming devices compete against one another for one or more awards. In one such embodiment, a plurality of players at a plurality of linked gaming devices participate in a gaming tournament for one or more awards. In another embodiment, a plurality of players at a plurality of linked gaming devices play for one or more awards wherein an outcome generated by one gaming device affects the outcomes generated by one or more linked gaming devices.

Bonus Sequence

Figure 3:
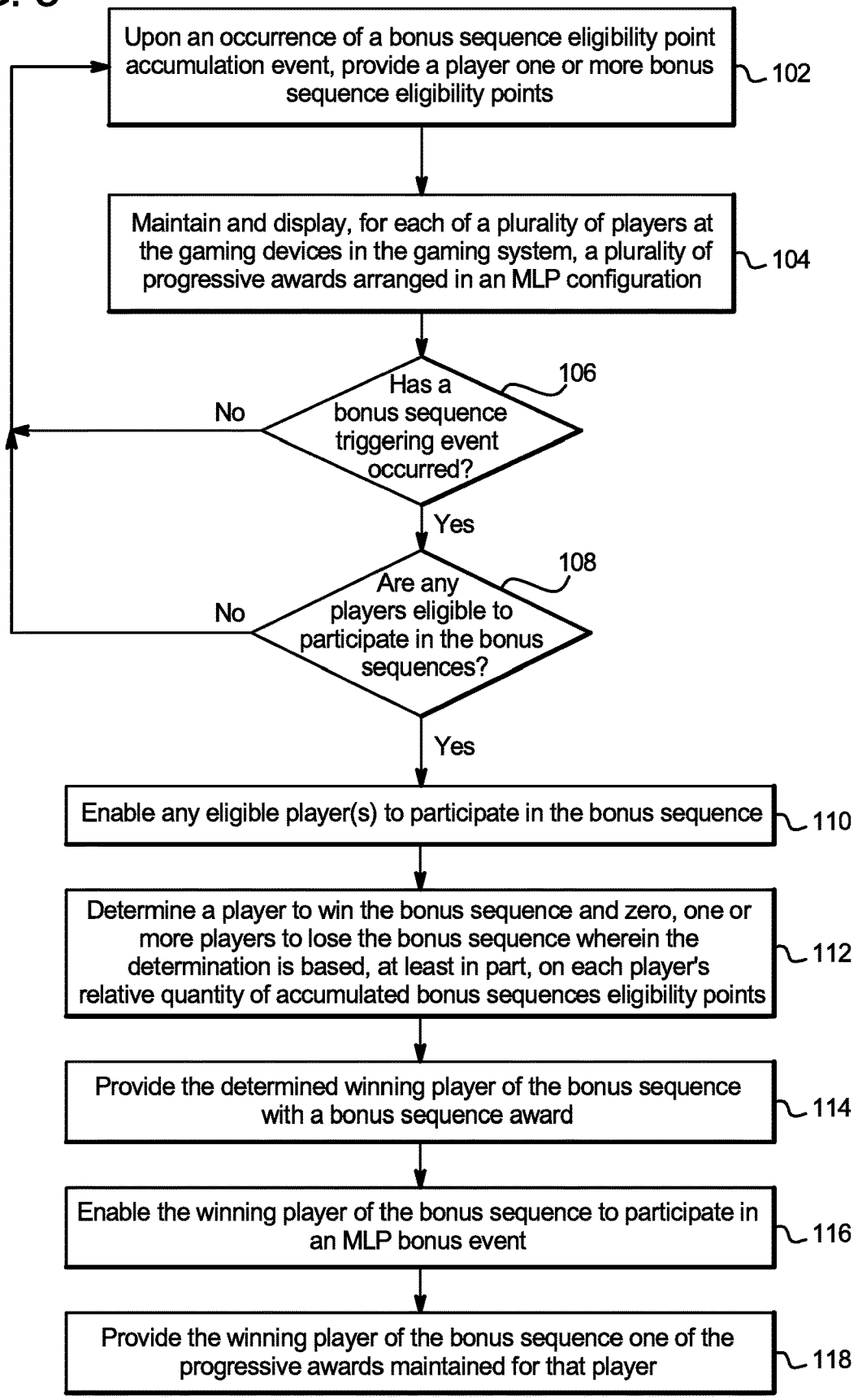
FIG. 3 is a flow-chart of one embodiment of the gaming system disclosed herein illustrating an accumulation of a bonus sequence eligibility points, enabling zero, one or more eligible players to participate in a bonus sequence and enabling any winner of the bonus sequence to participate in an MLP event.

Turning now to FIG. 3, in operation of one embodiment of the gaming system disclosed herein, upon an occurrence of a bonus sequence eligibility point accumulation event, the central controller and/or gaming device processor provides a player one or more bonus sequence eligibility points as indicated in block 102 of FIG. 3.

In one embodiment, a bonus sequence eligibility point accumulation event occurs if the gaming device generates a designated symbol or designated symbol combination for the play of the game and the player placed a bonus sequence wager (which is in addition to any non-bonus sequence wagers placed on the game). In another embodiment, a bonus sequence eligibility point accumulation event occurs if the gaming device generates a designated symbol or designated symbol combination for the play of the game, the played placed a wager on each available payline and the player placed the bonus sequence wager.

In different embodiments, the amount of the bonus sequence wager which a player must place to accumulate one or more bonus sequence eligibility points when the bonus sequence eligibility point accumulation occurs is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria. In another embodiment, if a bonus sequence eligibility point accumulation event occurs, the gaming system provides the player one or more bonus sequence eligibility points regardless of if the player placed the bonus sequence wager. In another embodiment, if a bonus sequence eligibility point accumulation event occurs and the player did not place the bonus sequence wager, the gaming system provides the player one or more bonus sequence eligibility points if the player otherwise satisfies one or more qualification criteria.

In another embodiment, a bonus sequence eligibility point accumulation event occurs and one or more bonus sequence eligibility points are provided based on a displayed event in a play of one or more displayed games of one or more of the gaming devices in the gaming system. In another embodiment, a bonus sequence eligibility point accumulation event occurs and one or more bonus sequence eligibility points are provided independent of any displayed event in any play of any game of any of the gaming devices in the gaming system.

In one embodiment, the quantity of bonus sequence eligibility points provided to (i.e., accumulated by) the player is based on the non-bonus sequence wager placed on the game. For example, if a first player places a first wager amount on each available payline of a game (in addition to a bonus sequence wager) and the gaming device generates a designated symbol or symbol combination in the play of the game, the gaming system provides the first player a first quantity of bonus sequence eligibility points based on the wager amount placed on the activated payline which ran through the designated symbol or symbol combination. In this example, if a second player places a second, greater wager amount on each available payline of a game (in addition to a bonus sequence wager) and the gaming device generates a designated symbol or symbol combination in the play of the game, the gaming system provides the second player a second, greater quantity of bonus sequence eligibility points based on the wager amount placed on the activated payline which ran through the designated symbol or symbol combination. In different embodiments, the quantity of bonus sequence eligibility points provided to the player for an occurrence of a bonus sequence eligibility point accumulation event is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

In one embodiment, each bonus sequence eligibility point is associated with a linked, inherent or escrowed value or amount. In one such embodiment, this linked value or amount is equal to or substantially equal to the average expected payout of the MLP event. In this embodiment, since each bonus sequence eligibility point is associated with a linked value equal to or substantially equal to the average expected payout of the MLP event, each bonus sequence eligibility point is equivalent to a stored trigger of the MLP event. Accordingly, one embodiment of the gaming system disclosed herein provides one or more triggers of an MLP event, wherein displaying such MLP events (and providing an award for such MLP events) is delayed until a subsequent time in which part or all of the stored payouts of the triggered bonus events are provided to a player. In another embodiment, each bonus sequence eligibility point is associated with a theoretical linked, inherent or escrowed value or amount.

In one embodiment, the gaming system is operable to cause such accumulated bonus sequence eligibility points to be forfeited based on the occurrence of one or more events or the lack of the occurrence of one or more events at one or more of the gaming devices in the gaming system. In one such embodiment, if a player is inactive for a designated period of time after accumulating one or more bonus sequence eligibility points, the player forfeits one or more of the player's accumulated bonus sequence eligibility points. In another embodiment, if a player is inactive for a designated period of time after the conclusion of a previous game (or previous bonus sequence or MLP event), the player forfeits one or more of the player's accumulated bonus sequence eligibility points. In these embodiments, if the gaming system determines a gaming device's status as inactive, the gaming system causes one or more of the accumulated bonus sequence eligibility points to be forfeited.

In one such embodiment, a gaming device (or a player currently at the gaming device) is active if the gaming device is being actively played by a player during a designated period. The active status requirements can be based on any suitable number of satisfied criteria or defined in any suitable manner by the implementer of the gaming system. For instance, a play of or wager on the primary game of the gaming device within a predetermined period of time may be part of the determination of whether that gaming device (or the player currently at that gaming device) is in the active status. Other factors such as: (a) the amount of time between each play of or wager on the primary game of the gaming device; (b) the amount being wagered on the primary game(s); (c) the number of plays within a period of time, and (d) the existence of credits on the gaming device (i.e., did the player cash out) may also or alternatively be part of the determination of whether a gaming device (or the player currently at that gaming device) is in the active status. On the other hand, inactive status means that the gaming device is one of the gaming machines in the gaming system, but is not in the active status (i.e., not being actively played by a player according to one or more of the predetermined criteria) during the designated period.

In one example embodiment, to retain any accumulated bonus sequence eligibility points, a player must place one or more wagers on the primary game of the gaming device during a designated time period of 15 seconds since the last placed wager (or conclusion of the last played game). In this example embodiment, if the player has accumulated any bonus sequence eligibility points and the gaming device remains idle for 8 seconds (i.e., the player has not placed a wager in 8 seconds), the gaming device displays an alert to the player that they will forfeit their bonus sequence eligibility points unless they make another wager. In this example embodiment, if the player does not place another wager within the next 7 seconds (for a total of 15 seconds since the last placed wager or conclusion of the last played game), the gaming device displays an alert to the player that they have forfeited their bonus sequence eligibility points. In one such example embodiment, the gaming device displays appropriate messages such as "TO RETAIN YOUR ACCUMULATED BONUS SEQUENCE ELIGIBILITY POINTS, PLACE A WAGER IN THE NEXT 7 SECONDS" and "YOUR INACTIVITY RESULTED IN FORFEITURE OF YOUR ACCUMULATED BONUS SEQUENCE ELIGIBILITY POINTS" to the player visually, or through suitable audio or audiovisual displays.

In another embodiment, the determination of if a gaming device (or player at a gaming device) is active or inactive for retention of any accumulated bonus sequence eligibility points is the same for each player. For example, if any player does not place a wager within a designated period of 15 seconds since the conclusion of the previous game, the gaming system causes one or more of that player's accumulated bonus sequence eligibility points to be forfeited. In another embodiment, the determination of if a gaming device (or player at a gaming device) is active or inactive for retention of any accumulated bonus sequence eligibility points is different for a plurality of players. For example, a first player must place a wager within a designated period of 15 seconds since the conclusion of the previous game to avoid forfeiting any of that player's accumulated bonus sequence eligibility points, while a second player must place a wager within a designated period of 25 seconds since the conclusion of the previous game to avoid forfeiting any of that player's accumulated bonus sequence eligibility points. In different embodiments, the determination of if a gaming device (or player at a gaming device) is active or inactive for retention of any accumulated bonus sequence eligibility points is predetermined, randomly determined, determined based on a player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

In another embodiment, if a gaming device's credit meter is reduced to zero credits and the player does not fund the credit meter, the gaming device (or the player playing at that gaming device) is classified as inactive. In one such embodiment, if a gaming device's credit meter is reduced to zero, at the end of a play of a game the gaming device displays an alert to the player that they will forfeit their bonus sequence eligibility points unless they fund the credit meter within a designated period of time. In one embodiment, the gaming system enables the player to exchange one or more accumulated bonus sequence eligibility points for an amount of credit to fund the credit meter. In one such embodiment, the gaming system enables a player to retain one or more bonus sequence eligibility points and also exchange one or more accumulated bonus sequence eligibility points for an amount of credit to fund the credit meter. In different embodiments, the determinations of whether a player may exchange bonus sequence eligibility points for an amount of credit, and/or the rate for such exchanges is predetermined, randomly determined, determined based that player's status (determined through a suitable player tracking system), determined based on a random determination by the central controller, determined based on a random determination at the gaming machine, determined based on one or more side wagers placed, determined based on the player's primary game wager, determined based on time (such as the time of day) or determined based on any other suitable method or criteria.

In one embodiment, for each occurrence of a gaming device (or the player playing at that gaming device) remaining inactive for the designated period, the gaming system causes one accumulated bonus sequence eligibility point to be forfeited. In another embodiment, for each occurrence of a gaming device (or the player playing at that gaming device) remaining inactive for the designated period, the gaming system causes a plurality of accumulated bonus sequence eligibility points to be forfeited. In another embodiment, for each occurrence of a gaming device (or the player playing at that gaming device) remaining inactive for the designated period, the gaming system causes each of the player's accumulated bonus sequence eligibility points to be forfeited. In different embodiments, the quantity of bonus sequence eligibility points the gaming system forfeits for a player if a gaming device's status remains inactive for the designated period is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

In one embodiment, if a player forfeits a bonus sequence eligibility point, the gaming system (i) provides to a player a portion of a linked, inherent or escrowed value of the forfeited bonus sequence eligibility point, and (ii) contributes another portion of the linked, inherent or escrowed value of the forfeited bonus sequence eligibility point to a bonus sequence award. In one embodiment, the gaming system maintains at least one bonus sequence award which is provided to the determined winning player of the bonus sequence (or the determined winning player of a subsequently provided bonus sequence). Thus, the gaming system disclosed herein provides that even if a bonus sequence eligibility point is forfeited, at least a portion of the linked value of that bonus sequence eligibility point is still provided to one of the players at one of the gaming devices in the gaming system. For example, if a player forfeits a bonus sequence eligibility point with a linked value of $150, $30 is provided to the player and $120 funds a maintained bonus sequence award as described below. In another embodiment, if a player forfeits a bonus sequence eligibility point, the entire linked value of the forfeited bonus sequence eligibility point is contributed to the bonus sequence award. In different embodiments, if a player forfeits a bonus sequence eligibility point, the amount of any linked value of the bonus sequence eligibility point provided to the player is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

It should be appreciated that even though each bonus sequence eligibility point is associated with a linked value which will be provided to one or more players at the gaming devices in the gaming system, such a linked value will not necessarily be provided to the player which accumulated the bonus sequence eligibility point. In one such embodiment, as described below, at least part of the value associated with one or more bonus sequence eligibility points is provided in the form of a bonus sequence award to the winner of a bonus sequence.

In one embodiment, in addition to tracking the accumulation of one or more bonus sequence eligibility points for one or more players at one or more gaming devices, the gaming system maintains and displays, for each of a plurality of players at the gaming devices in the gaming system, a plurality of progressive awards arranged in an MLP configuration as seen in block 104 of FIG. 3. In one such embodiment, for each player, the value of one or more of the maintained progressive awards is based at least in part on a quantity of that player's accumulated bonus sequence eligibility points and a base, start-up or reset amount for that progressive award. That is, the value of one or more progressive awards of the MLP are personal and specific to each player. It should be appreciated that while one or more progressive awards of the MLP are personal to each player, one or more progressive awards of the MLP for one player may be transferred to being maintained for another player. For example, if a first player leaves a gaming device without notifying the gaming system (e.g., by removing a player tracking), a second player begin play at the gaming device (within the designated period to retain active status) and such progressive awards of the MLP maintained for the first player will be maintained for the second player.

In one embodiment, the progressive awards for each player are further funded by an increment value which is based on allocating a percentage of each player's coin-in or wagered amounts to one or more of the progressive awards of the MLP. For example, if a first player is currently associated with one accumulated bonus sequence eligibility point, the first progressive award is associated with a base value of $100 and the progressive award has incremented $20 (based on the wagers placed at the gaming devices in the gaming system), the first progressive award for the first player is currently valued at $220 (or ($100×2)+$20). It should be appreciated that in this example embodiment, the base value of the first progressive award is modified by a factor of two, wherein the first or default modifier of 1× accounts for the base value of the first progressive award and the second modifier of 1× accounts for the one accumulated bonus sequence eligibility point. In another example embodiment wherein a first player is currently associated with one accumulated bonus sequence eligibility point, the base value of the first progressive award is modified by a factor of one which accounts for both the base value of the first progressive award the one accumulated bonus sequence eligibility point. It should be further appreciated that while the modifier for the base value of any progressive award is specific to each player (and based on that player's quantity of accumulated bonus sequence eligibility points), in one embodiment, the increment value for the progressive awards are the same for each player.

Figure 4:
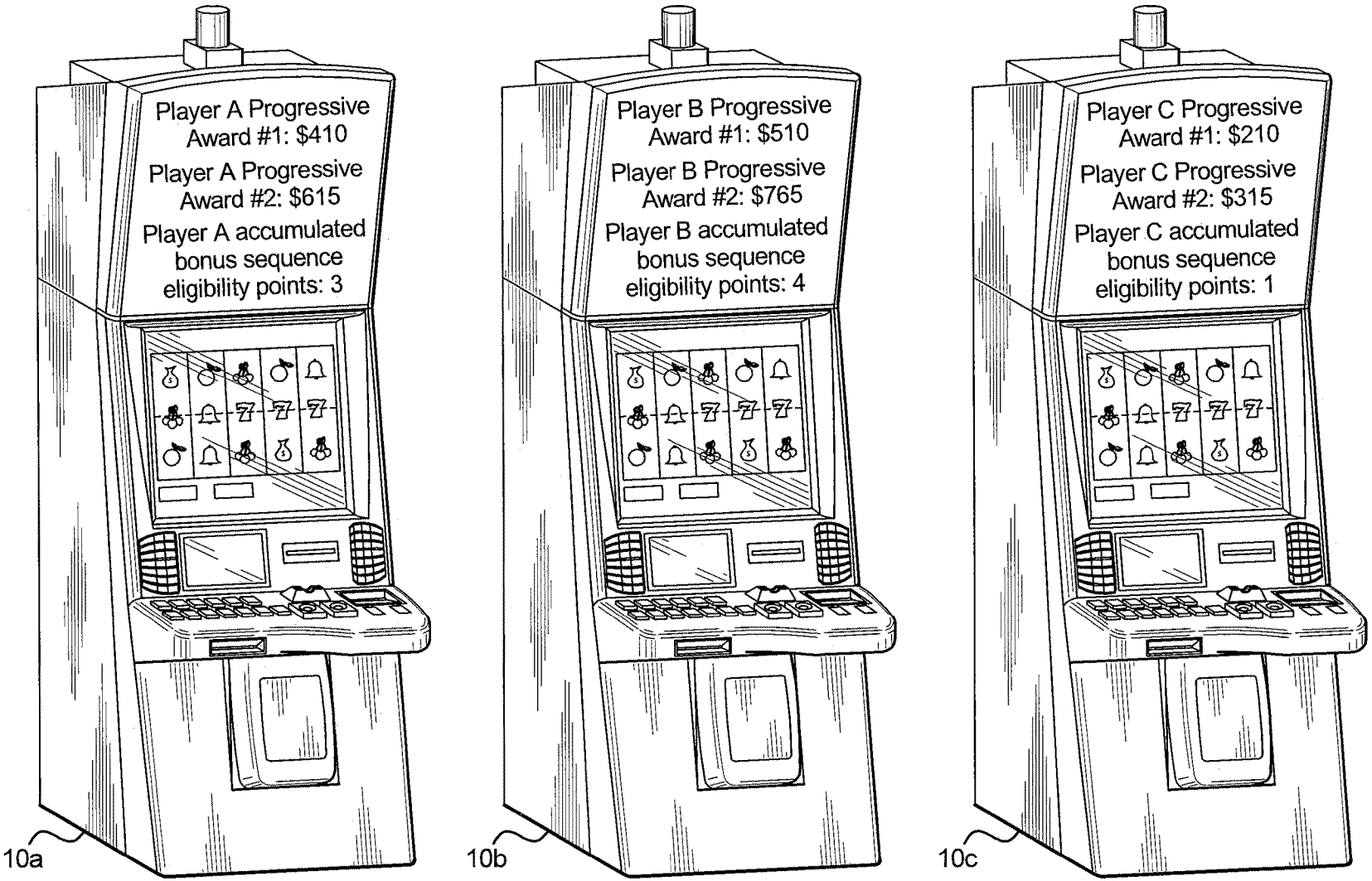
FIG. 4 is a schematic diagram of one embodiment of the gaming system disclosed herein illustrating a plurality of gaming devices, wherein each gaming machine is played by a player who is associated with a plurality of progressive awards.

In one of the gaming systems disclosed herein, as different players may accumulate different numbers of bonus sequence eligibility points, the gaming system provides that the value of one or more of the progressive awards of the MLP for one player may be different than the value of one or more of the progressive awards of the MLP for another player. For example, as seen in FIG. 4, at a first point in time, a first progressive award is associated with a base value of $100, a second progressive award is associated with a base value of $150, the first progressive award is associated with a current increment value of $10 (based on the wagers placed at the gaming devices in the gaming system) and the second progressive award is associated with a current increment value of $15 (based on the wagers placed at the gaming devices in the gaming system). In this example, for a first player at a first of the gaming devices (i.e., Player A at gaming device 10*a*) with three accumulated bonus sequence eligibility points, the gaming system maintains a first progressive award (i.e., Player A Progressive Award #1) currently valued at $410 (or ($100×4)+$10) and a second progressive award (i.e., Player A Progressive Award #2) currently valued at $615 (or ($150×4)+$15). In this example, for a second player at a second of the gaming devices (i.e., Player B at gaming device 10*b*) with four accumulated bonus sequence eligibility points, the gaming system maintains a first progressive award (i.e., Player B Progressive Award #1) currently valued at $510 (or ($100×5)+$10) and a second progressive award (i.e., Player B Progressive Award #2) currently valued at $765 (or ($150×5)+$15). Moreover, in this example, for a third player at a third of the gaming devices (i.e., Player C at gaming device 10*c*) with one accumulated bonus sequence eligibility point, the gaming system maintains a first progressive award (i.e., Player C Progressive Award #1) currently valued at $210 (or ($100×2)+$10) and a second progressive award (i.e., Player C Progressive Award #2) currently valued at $315 (or ($150×2)+$15).

Figure 5:
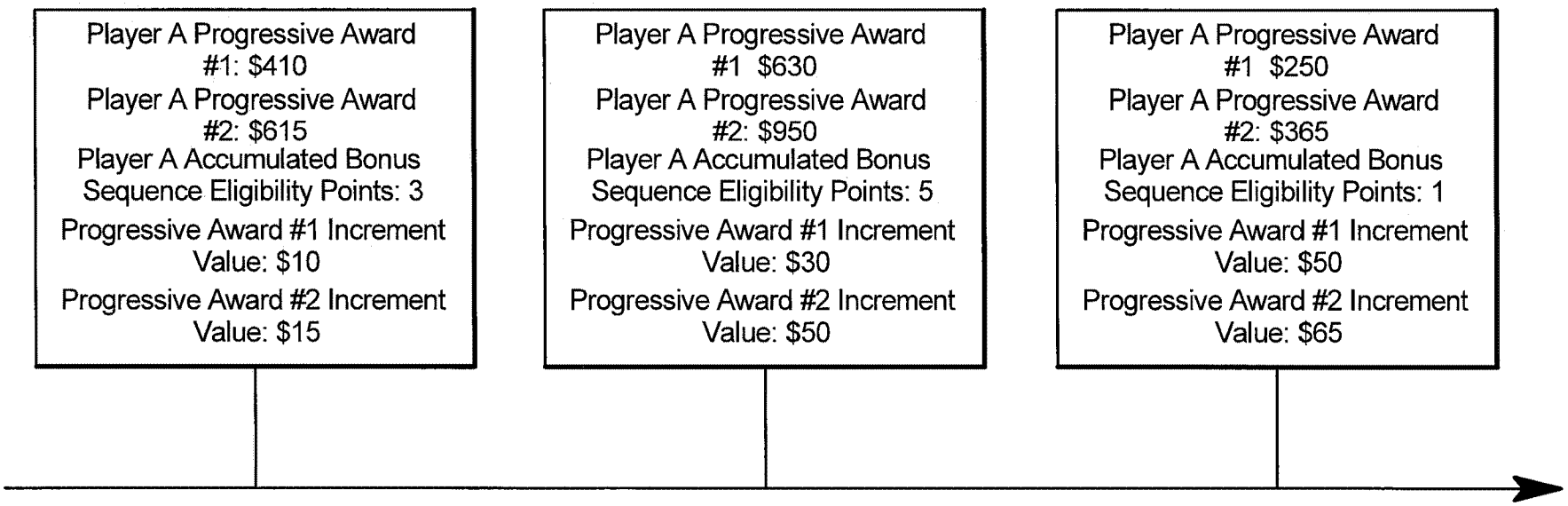
FIG. 5 is a timeline illustrating a player accumulating and forfeiting bonus sequence eligibility points and how this affects the progressive awards maintained for that player.

In one embodiment of the gaming system disclosed herein, as a player may accumulate and forfeit bonus sequence eligibility points over a course of a plurality of plays of the gaming devices, the gaming system provides that the value of one or more of the progressive awards of the MLP for one player may be different at different points in time of the player's gaming experience. For example, as seen in FIG. 5, a first progressive award is associated with a base value of $100, and a second progressive award is associated with a base value of $150. In this example, at the first point in time described above, wherein the first player at the first of the gaming devices (i.e., Player A) has three accumulated bonus sequence eligibility points, the first progressive award is associated with a current increment value of $10 (based on the wagers placed at the gaming devices in the gaming system) and the second progressive award is associated with a current increment value of $15 (based on the wagers placed at the gaming devices in the gaming system), the gaming system maintains a first progressive award (i.e., Player A Progressive Award #1) currently valued at $410 (or ($100×4)+$10) and a second progressive award (i.e., Player A Progressive Award #2) currently valued at $615 (or ($150×4)+$15). In this example, at a second, subsequent point in time when the first player has five accumulated bonus sequence eligibility points, the first progressive award is associated with a current increment value of $30 (based on the wagers placed at the gaming devices in the gaming system) and the second progressive award is associated with a current increment value of $50 (based on the wagers placed at the gaming devices in the gaming system), the gaming system maintains a first progressive award (i.e., Player A Progressive Award #1) currently valued at $630 (or ($100×6)+$30) and a second progressive award (i.e., Player A Progressive Award #2) currently valued at $950 (or ($150×6)+$50). In this example, at a third, subsequent point in time when the first player has one accumulated bonus sequence eligibility point, the first progressive award is associated with a current increment value of $50 (based on the wagers placed at the gaming devices in the gaming system) and the second progressive award is associated with a current increment value of $65 (based on the wagers placed at the gaming devices in the gaming system), the gaming system maintains a first progressive award (i.e., Player A Progressive Award #1) currently valued at $250 (or ($100×2)+$50) and a second progressive award (i.e., Player A Progressive Award #2) currently valued at $365 (or ($150×2)+$65).

In one embodiment, the central server determines if a bonus sequence triggering event occurs as indicated in diamond 106 of FIG. 3. In one such embodiment, the bonus sequence triggering event occurs based on an elapsed period of time, such as eight minutes since the last occurrence of a bonus sequence triggering event. In this embodiment, when a designated amount of time is left until the time-based bonus sequence triggering event, one or more of the gaming devices display an alert to show the players the upcoming occurrence of a bonus sequence triggering event. For example, one minute before the occurrence of a bonus sequence triggering event, a gaming device shows a countdown clock counting down from 60 seconds to 0 seconds.

In another embodiment, the gaming system tracks the occurrences of one or more suitable events occurring at or in association with one or more players and/or one or more gaming devices in the gaming system and determines, based on these tracked events, whether a bonus sequence triggering event has occurred. In another embodiment, the gaming system defines one or more game play parameters, wherein each time a player's tracked game play activity satisfies the defined parameter, the bonus sequence triggering event occurs. In another such embodiment, the bonus sequence triggering event occurs based on a displayed event in a play of one or more games (or an accumulation of one or more displayed events in one or more plays of one or more games) of one or more of the gaming devices in the gaming system. In another such embodiment, the bonus sequence triggering event occurs independent of any displayed event in any play of any game of any of the gaming devices in the gaming system.

In one embodiment, if the determination is that the bonus sequence triggering event has not occurred, the gaming system continues maintaining the progressive awards, providing bonus sequence eligibility points and forfeiting accumulated bonus sequence eligibility points as described above. In this embodiment, if the determination is that bonus sequence triggering event occurs, the gaming system determines if any players are eligible to participate in the bonus sequence as indicated in diamond 108 of FIG. 3.

In one such embodiment, a player is eligible to participate in the bonus sequence if the player has accumulated one or more bonus sequence eligibility points and retained such bonus sequence eligibility points (i.e., the bonus sequence eligibility points have not been forfeited). For example, when the bonus sequence triggering event occurs, if Player A currently has four accumulated bonus sequence eligibility points, Player B currently has zero accumulated bonus sequence eligibility points (i.e., Player B's four accumulated bonus sequence eligibility points described in the example above have been forfeited), and Player C currently has three accumulated bonus sequence eligibility points, the gaming system determines that Player A and Player C are eligible to participate in the bonus sequence and Player B is ineligible to participate in the bonus sequence.

In one embodiment, if the gaming system determines that no players are eligible to participate in the bonus sequence, the gaming system continues maintaining the progressive awards, providing bonus sequence eligibility points and forfeiting accumulated bonus sequence eligibility points as described above. That is, even if a bonus sequence triggering event occurs, if the gaming system determines that no players are eligible to participate in the triggered bonus sequence (i.e., no players have at least one accumulated and retained bonus sequence eligibility point), the gaming system does not display and provide the bonus sequence to any players at the gaming devices in the gaming system.

On the other hand, if the gaming system determines that at least one player is eligible to participate in the bonus sequence, the gaming system enables such eligible player(s) to participate in the bonus sequence as indicated in block 110 of FIG. 3. For example, upon the determination to provide the bonus sequence to one or more eligible players, the gaming system alerts one or more players at one or more gaming devices of such triggering of the bonus sequence and displays a suitable transition to the bonus sequence. In one embodiment, the bonus sequence is provided by the gaming device processor. In another embodiment, the bonus sequence is remotely provided by the central server.

In one such embodiment, the bonus sequence includes a competition game wherein each eligible player's chance of winning the bonus sequence is based on that player's accumulated bonus sequence eligibility points relative to the total number of bonus sequence eligibility points accumulated by the eligible players participating in the bonus sequence. For example, as seen in FIG. 6, utilizing the example described above, eligible Player A currently has three accumulated bonus sequence eligibility points, eligible Player C currently has five accumulated bonus sequence eligibility points, eligible Player D currently has one accumulated bonus sequence eligibility point, and eligible Player E currently has two accumulated bonus sequence eligibility points for a total of ten outstanding accumulated bonus sequence eligibility points. In this example, Player A has a 40% (or 4/10) chance of winning the bonus sequence, Player C has a 30% (or 3/10) chance of winning the bonus sequence, Player D has a 10% (or 1/10) chance of winning the bonus sequence, and Player E has a 20% (or 2/10) chance of winning the bonus sequence.

In one embodiment, the gaming system determines a player to win the bonus sequence and zero, one or more players to lose the bonus sequence, wherein the determination is based, at least in part, on each player's relative quantity of accumulated bonus sequence eligibility points as indicated in block 112 of FIG. 3. That is, based on the determined probabilities for each player, the gaming system determines one winning outcome and zero, one or more losing outcomes for the bonus sequence.

In one embodiment, each player's probability of winning the bonus sequence is based, at least in part, on that player's relative quantity of accumulated bonus sequence and based, at least in part, on that player's status (such as determined through a player tracking system). For example, a platinum level player with a first quantity of accumulated bonus sequence eligibility points has a greater probability of winning the bonus sequence than a gold level player with the same first quantity of accumulated bonus sequence eligibility points. In different embodiments, in addition to or instead of factoring in a player's accumulated bonus sequence eligibility points, a player's probability of winning the bonus sequence is predetermined, randomly determined, determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

In one embodiment, the gaming system utilizes a community display device to display the bonus sequence. In one such embodiment, the bonus sequence is displayed as a racing game wherein each participating gaming device is associated with a racer in the racing game. In this embodiment, the community display device displays the racing game and one or more display devices of each participating gaming device displays that gaming device's associated racer's position (relative to other racers associated with other participating gaming devices) and the progressive awards of the MLP for that gaming device. In one such embodiment, the gaming system displays the winning player's associated racer finishing the racing game and each of the non-winning player's associated racers crashing and not finishing the racing game.

It should be appreciated that any suitable primary game or secondary game may be incorporated as the bonus sequence provided to the players of the gaming device of the gaming system disclosed herein. In different embodiments, the bonus sequence may incorporate any of the types of games described herein, as well as any suitable puzzle-type game, any suitable persistence game, any suitable wheel game, any suitable selection game, any suitable offer and acceptance game, any suitable cascading symbols game, any suitable ways to win game, any suitable scatter pay game, any suitable group game or any other suitable type of game.

In different embodiments, the type of game utilized in the bonus sequence is predetermined, randomly determined, determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria. In different embodiment, the characteristics or features of each displayed bonus sequence is predetermined, randomly determined, determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

In one embodiment, the gaming system provides the determined winning player of the bonus sequence with a bonus sequence award as indicated in block 114 of FIG. 3. It should be appreciated that the this bonus sequence award is separate from any provided progressive award of the MLP maintained for the winning player of the bonus sequence as described below.

In one embodiment, for each of any players that participated in, but did not win, the bonus sequence, the gaming system provides such players a consolation award. In one such embodiment, the consolation award provided to each player is based on a portion of the linked value of that player's accumulated bonus sequence eligibility points. In this embodiment, the remaining portion of the linked value of that player's bonus sequence eligibility points is contributed to a bonus sequence award. For example, if Player E (associated with a 20% chance of winning the bonus sequence as seen in FIG. 6), does not win the bonus sequence and each of Player E's two accumulated bonus sequence eligibility points has a linked value of $150, then the gaming system displays and provides Player E with a consolation award of $80 ($40 for each accumulated bonus sequence eligibility point) and $220 ($110 for each accumulated bonus sequence eligibility point) funds the bonus sequence award.

In one embodiment, the bonus sequence award provided to the determined winning player of the bonus sequence is based, at least in part, on part or all of the linked value of each bonus sequence eligibility point forfeited by a player due to inactivity. That is, as described above, each bonus sequence eligibility point has a linked value, wherein when each bonus sequence eligibility point is forfeited, a portion of the linked value of such a bonus sequence eligibility point is contributed to a bonus sequence award. For example, if a player forfeits a bonus sequence eligibility point with a linked value of $150, $120 of that value funds a maintained bonus sequence award.

In one embodiment, the bonus sequence award provided to the winning player of the bonus sequence is further or alternatively based, at least in part, on part or all of the linked value of each bonus sequence eligibility point accumulated by a player that participated in but did not win a bonus sequence. In one such embodiment, the amount contributed to the bonus sequence award per bonus sequence eligibility point accumulated (and retained) by a player that participated in, but did not win the bonus sequence is the difference between the average expected payout provided to the determined winning player of the bonus sequence and the average consolation award provided to each player that participated in, but did not win the bonus sequence. Utilizing the example described above, Player E did not win the bonus sequence and thus $220 ($110 for each accumulated bonus sequence eligibility point) of the linked value of Player E's accumulated bonus sequence eligibility points fund the maintained bonus sequence award.

In one embodiment, the bonus sequence award provided to the winning player of the bonus sequence is further or alternatively based, at least in part, on a start-up value or amount associated with the bonus sequence award. In one embodiment, the start-up value or amount of the bonus sequence award is funded, at least in part, based on player's wagers at the gaming devices in the gaming system. In another embodiment, the start-up value of the bonus sequence award is funded, at least in part, via a side-bet or side-wager which the player may make (and which may be tracked via a side-bet meter). In another embodiment, the start-up value or amount associated with the bonus sequence award is funded, at least in part, via an amount provided by one or more marketing and/or advertising departments, such as a casino's marketing department.

It should be appreciated that utilizing a start-up value or amount associated with the bonus sequence award provides that the winning player of the bonus sequence is always provided an award for winning the bonus sequence. That is, even if no portion of the linked value of any bonus sequence eligibility points have been contributed to the played for bonus sequence award due to such bonus sequence eligibility points being forfeited or such bonus sequence eligibility points being accumulated by a player that participated in, but did not win the bonus sequence, the start-up value is still provided to the player as a bonus sequence award. For example, if $0 is contributed to a bonus sequence award on behalf of no bonus sequence eligibility points being forfeited, $0 is contributed to the bonus sequence award on behalf of no players participating in and not winning the bonus sequence, and the start-up value of $50 is associated with the bonus sequence award, then the winning player of the bonus sequence is still provided $50 as a bonus sequence award.

In one embodiment, the bonus sequence award provided to the player of the current bonus sequence is determined based on one or more events which occurred in association with a previous bonus sequence. That is, in one embodiment, the provided bonus sequence award is based on each bonus sequence eligibility point that is forfeited in association with a previous bonus sequence, each bonus sequence eligibility point held by a player that did not win a previous bonus sequence and a start-up value associated with the bonus sequence award. This embodiment provides that a player's activity (or inactivity) associated with a first bonus sequence and/or one or more outcomes determined in a first bonus sequence determine, at least in part, a bonus sequence award for a winning player of a second bonus sequence. For example, if for the current bonus sequence, $800 is contributed to a bonus sequence award for the forfeited bonus sequence eligibility points associated with obtaining eligibly in the bonus sequence described above, $660 is contributed to a bonus sequence award for the accumulated bonus sequence eligibility points accumulated by players that did not win the example bonus sequence described above, and $50 is contributed to a bonus sequence award as a bonus sequence award start-up value, then the winner of the next bonus sequence is provided a bonus sequence award of $1510. It should be appreciated that in this embodiment, the bonus sequence award provided to the player of the current bonus sequence is a set amount which is determined from a previous bonus sequence and thus predetermined prior to the beginning of the current bonus sequence.

In another embodiment, the bonus sequence award provided to the player of the current bonus sequence is determined based on one or more events which occurred in association with the current bonus sequence. That is, in one embodiment, the provided bonus sequence award is based on each bonus sequence eligibility point that is forfeited in association with the current bonus sequence, each bonus sequence eligibility point held by a player that did not win the current bonus sequence and a start-up value associated with the bonus sequence award. This embodiment provides that a player's activity (or inactivity) associated with a current bonus sequence and/or one or more outcomes determined in the current bonus sequence determine, at least in part, a bonus sequence award for a winning player of a current bonus sequence. For example, if $800 is contributed to a bonus sequence award for the forfeited bonus sequence eligibility points associated with obtaining eligibly in the bonus sequence described above, $660 is contributed to a bonus sequence award for the accumulated bonus sequence eligibility points accumulated by players that did not win the example bonus sequence described above, and $50 is contributed to a bonus sequence award as a bonus sequence award start-up value, then the winner of the current bonus sequence is provided a bonus sequence award of $1510.

In one embodiment, in addition to providing the winner of the bonus sequence with the above-described bonus sequence award, the gaming system enables the winning player of the bonus sequence to participate in an MLP bonus event as indicated in block 116 of FIG. 3. In the MLP bonus event, the gaming system provides the winning player of the bonus sequence one of the progressive awards maintained for that player as indicated in block 118 of FIG. 3.

In one embodiment, the MLP bonus event includes enabling the player to make one or more inputs or decisions for one or more rounds or levels, wherein the result of such inputs determines which of the progressive awards of the MLP to provide to the player. In one such embodiment, the MLP bonus event includes a plurality of levels, wherein each level is associated one of the progressive awards. In this embodiment, a player begins playing the MLP bonus event at a first or default level associated with a first of the progressive awards. If the player is unsuccessful with one or more inputs at their current level (in this case the first level), the gaming system provides the player the progressive award associated with their current level and the MLP bonus event ends. If the player successfully completes the current level, the player advances to any subsequent level and plays for the progressive award associated with that level. This advancement proceeds until the player is unsuccessful with their current level (and wins the progressive award of that level) or the player successfully completes the top level (and wins the top level progressive award of the MLP).

In one example embodiment, the MLP event includes a plurality of levels wherein each level is associated with a MLP event point threshold. For each level, the gaming system displays a plurality of selections, wherein each selection is associated with zero, one or more MLP event points based on a probability table associated with that level. In this example embodiment, the gaming system begins the MLP event at a first level and enables the player of the MLP event to pick one or more of the selections of this level. If the player's picked selections are associated with an MLP event point total that is less than the MLP event point threshold for the first level, the gaming system provides the player the progressive award associated with the first level and the MLP event ends. On the other hand, if the player's picked selections are associated with an MLP event point total that equals or exceeds the MLP event point threshold for the first level, the gaming system advances the player to the second level. After advancing the player to the next level, the MLP event continues as described above until the player fails to obtain enough points to reach or exceed the current level's MLP event point threshold (and the gaming system provides the player the progressive award associated with the current level and the MLP event ends) or the gaming system provides player the top progressive award associated with the top level of the MLP and the MLP event ends. It should be appreciated that this provided progressive award of the MLP maintained for the winning player of the bonus sequence is separate from any provided bonus sequence award described above. That is, the gaming system and method disclosed herein is configured to provide a player both (i) a bonus sequence award (wherein the player's accumulated bonus sequence eligibility points at least partially determine the player's relative probability of winning the bonus sequence award) and (ii) one of the progressive awards of the MLP maintained for that player (wherein the player's accumulated bonus sequence eligibility points at least partially determine the value of at least one of such progressive awards).

For example, if Player A is the winner of the bonus sequence, Player A's first progressive award is currently valued at $250, and Player A's selections in the MLP event are associated with a total number of MLP event points less than the point threshold for the first level, the gaming system displays a spacecraft associated with Player A as being destroyed by an enemy spacecraft and provides Player A the first progressive award of $250. In another example, if Player A's selections in the MLP event are associated with a total number of MLP event points at least equal to the MLP event point threshold for the first level, the gaming system displays a spacecraft associated with Player A destroying one or more enemy spacecraft and advances Player A to the second level (in which Player A is playing for Player A's second progressive award currently valued at $365). It should be appreciated that this example embodiment illustrates the player obtaining MLP event points toward a MLP event point level threshold as the deterioration of one or more images.

It should be further appreciated that any suitable primary game or secondary game may be incorporated as the MLP event provided to the players of the gaming device of the gaming system disclosed herein. In different embodiments, the MLP event may incorporate any of the types of games described herein, as well as any suitable puzzle-type game, any suitable persistence game, any suitable wheel game, any suitable selection game, any suitable offer and acceptance game, any suitable cascading symbols game, any suitable ways to win game, any suitable scatter pay game, any suitable group game or any other suitable type of game.

In different embodiments, the type of game utilized in the MLP event is predetermined, randomly determined, determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria. In different embodiment, the characteristics or features of each displayed MLP event is predetermined, randomly determined, determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

FIG. 7 illustrates one example embodiment of the operation of gaming system disclosed herein, wherein each bonus sequence eligibility point has a linked value of $200 and the bonus sequence award of $2000 from a previous bonus sequence is provided to a player that participates in and wins the current bonus sequence. In this example, at a first point in time (designated by numeral 120), a first player (i.e., Player A) has accumulated four bonus sequence eligibility points, a second player (i.e., Player B) has accumulated five bonus sequence eligibility points and a third player (i.e., Player C) has accumulated six bonus sequence eligibility points). As described above, each player's quantity of accumulated bonus sequence eligibility points affects one or more of the values of the progressive awards maintained for that player (not illustrated).

As further seen in FIG. 7, at a second point in time (designated by numeral 122), Player A has forfeited two bonus sequence eligibility points (due to player inactivity) to bring Player A's total accumulated bonus sequence eligibility points to two. In this example, since Player A has forfeited two bonus sequence eligibility points (which each have a linked value of $200), Player A is provided $100 (or $50 for each forfeited bonus sequence eligibility point) and $300 (or $150 for each forfeited bonus sequence eligibility point) is contributed to the bonus sequence award for the next bonus sequence. This $300 contributed to the next bonus sequence award is combined with a $50 start-up value associated with the next bonus sequence award, such that at the second point in time, the next bonus sequence award has a current value of $350. It should be appreciated that by the second point in time, Player B has accumulated one more bonus sequence eligibility point (to bring Player B's total to six accumulated bonus sequence eligibility points) and Player C has accumulated two more bonus sequence eligibility points (to bring Player C's total to eight accumulated bonus sequence eligibility points).

At a third point in time of FIG. 7 (designated by numeral 124), Player B has forfeited six bonus sequence eligibility points (due to player inactivity) to bring Player B's total accumulated bonus sequence eligibility points to zero. In this example, since Player B has forfeited six bonus sequence eligibility points (which each have a linked value of $200), Player B is provided $300 (or $50 for each forfeited bonus sequence eligibility point) and $900 (or $150 for each forfeited bonus sequence eligibility point) is contributed to the bonus sequence award for the next bonus sequence. This $900 contributed to the next bonus sequence award is combined with the $350 above-described contributions to the next bonus sequence award, such that at the third point in time, the next bonus sequence award has a current value of $1250. It should be appreciated that by the third point in time, Player A has accumulated four more bonus sequence eligibility point (to bring Player A's total to six accumulated bonus sequence eligibility points) and Player C has accumulated four more bonus sequence eligibility points (to bring Player C's total to twelve accumulated bonus sequence eligibility points).

As also seen in FIG. 7, the gaming system determines that a bonus sequence triggering event occurs at a fourth point in time (designated by numeral 126). At this point in time, the gaming system determines that Player A and Player C have at least one accumulated bonus sequence eligibility point, thus Player A and Player C each participate in the bonus sequence. In this example, based on each player's accumulated bonus sequence eligibility points relative to the total number of bonus sequence eligibility points accumulated by the players participating in the bonus sequence, Player A has a 33% (or $6/18$) chance of winning the bonus sequence and Player B has a 67% (or $12/18$) chance of winning the bonus sequence. In this case, Player C wins the bonus sequence and is provided the bonus sequence award of $2000 from the previous bonus sequence. Additionally, since Player A participated in, but did not win the bonus sequence, Player A is provided $300 (or $50 for each accumulated bonus sequence eligibility point) and $900 (or $150 for each accumulated bonus sequence eligibility point) is contributed to the bonus sequence award for the next bonus sequence. This $900 contributed to the next bonus sequence award is combined with the $1250 above-described contributions to the next bonus sequence award, such that at the fourth point in time, the next bonus sequence award has a current value of $2150. Accordingly, the determined winner of the next bonus sequence is provided this bonus sequence award of $2150.

After providing Player C the bonus sequence award of $2000 from a previous bonus sequence, the gaming system enables Player C to participate in the MLP event. In the MLP event, Player C plays for one of the progressive awards of the MLP maintained for Player C, wherein the value of each progressive award is based, at least in part, on the quantity of Player C's accumulated bonus sequence eligibility points. For example, as seen in FIG. 7, a first level progressive award of the MLP is currently valued at $120 (a base value of $10×12 accumulated bonus sequence eligibility points), a second level progressive award of the MLP is current valued at $600 (a base value of $50×12 accumulated bonus sequence eligibility points), a third level progressive award of the MLP is currently valued at $1200 (a base value of $100×12 accumulated bonus sequence eligibility points), and a fourth level progressive award of the MLP is currently valued at $12,000 (a base value of $10×12 accumulated bonus sequence eligibility points). In this example, Player C wins the second level progressive award of $600 and Player C's progressive awards and quantity of accumulated bonus sequence eligibility points reset.

Accordingly, in this illustrated example for one bonus sequence, Player A is provided a total award of $400 (from the forfeiture of two bonus sequence eligibility points and for participating in, but not winning the bonus sequence with six accumulated bonus sequence eligibility points); Player B is provided a total award of $300 (from the forfeiture of six bonus sequence eligibility points); and Player C is provided a total award of $2600 (from winning the previous bonus sequence award for winning the current bonus sequence and from winning the second level progressive award of the MLP maintained for Player C).

In one embodiment, if the bonus sequence triggering event occurs, the gaming system enables the player to forfeit one or more bonus sequence eligibility points for a portion of the bonus sequence award. In one such embodiment, the portion of the bonus sequence award provided to the player for each forfeited bonus sequence eligibility point is greater than the amount provided to a player for participating in but not winning the bonus sequence and less than the linked value of the forfeited bonus sequence eligibility point. In different embodiments, the portion of the bonus sequence award provided to the player for each of such forfeited bonus sequence eligibility points is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

In one embodiment, if the bonus sequence triggering event occurs, the gaming system enables the player to defer or delay their participation in such a bonus sequence. In this embodiment, the gaming system enables the player to escrow or save one or more bonus sequence eligibility points for eligibility in a subsequent bonus sequence.

In another embodiment, stored bonus sequence eligibility points are associated with a time period for usage. Such stored bonus sequence eligibility points may be associated with a time of day, certain day(s) of week, a month and/or a year which they can be used. In one such embodiment, the central server excludes the player from utilizing one or more stored bonus sequence eligibility points during certain days and times.

In another embodiment, stored bonus sequence eligibility points are associated with an expiration date and time. In this embodiment, the gaming system/gaming device is configured to communicate to the player the proximity of the expiration of any stored bonus sequence eligibility points (i.e., "your bonus sequence eligibility points will expire at 6:00 am tomorrow"). In one embodiment, such notice of expiration of any stored bonus sequence eligibility points is at the player's currently played gaming device. In another embodiment, such notice of expiration of any stored bonus sequence eligibility points is external from the player's currently played gaming device, such as via e-mail. In different embodiments, if multiple bonus sequence eligibility points are stored in associated with a player's account, the use of such stored bonus sequence eligibility points are provided to the player in order of expiration (first to expire shows first), in order of first earned basis.

In one embodiment, the gaming system accumulates bonus sequence eligibility points and maintains one or more progressive awards for all carded members of a gaming establishment's player tracking club. In this embodiment, the gaming system enables all carded members to accumulate bonus sequence eligibility points, play for a bonus sequence award and play for one or more progressive awards. In another embodiment, the gaming system accumulates bonus sequence eligibility points and maintains one or more progressive awards for all players currently playing gaming devices in the gaming system (i.e., a player tracking card is not required to participate in the features disclosed herein).

In one embodiment, the above-described attributes of the progressive awards of a MLP configuration (e.g., the starting value, the percentage of wagers placed which fund the personal progressive awards) are the same for each player. In another embodiment, such above-described attributes of the progressive awards are different for a plurality of players. In another embodiment, such above-described attributes of the progressive awards are different for each of plurality of players. In one such embodiment, the attributes of the progressive awards of a MLP configuration are based on a specific player's status determined through a player tracking system. For example, one or more of the progressive awards associated with a player of platinum level player tracking status may have a default starting value greater than the default starting value of one or more of the progressive awards associated with a player of gold level player tracking status. In different embodiments, the attributes associated with one or more of the progressive awards associated with one or more players is predetermined, randomly determined, determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

In one embodiment, the portion of the linked value of the bonus sequence eligibility point provided to the player as a consolation award for forfeiting their accumulated bonus sequence eligibility point(s) due to inactivity is the same as the portion of the linked value of the bonus sequence eligibility point provided to the player as a consolation award for participating in, but not winning the bonus sequence. In another embodiment, the portion of the linked value of the bonus sequence eligibility point provided to the player as a consolation award for forfeiting their accumulated bonus sequence eligibility point(s) due to inactivity is different than the portion of the linked value of the bonus sequence eligibility point provided to the player as a consolation award for participating in, but not winning the bonus sequence. In different embodiments, the portion of the linked value of the bonus sequence eligibility point provided to the player as a consolation award for forfeiting their accumulated bonus sequence eligibility point(s) due to inactivity and/or for participating in, but not winning the bonus sequence is predetermined, randomly determined, determined based on the player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

In another embodiment, a bonus sequence eligibility point accumulation event occurs and one or more bonus sequence eligibility points are provided based on an amount coin-in. In this embodiment, the gaming system determines if an amount of coin-in wagered at one or more gaming devices in the gaming system reaches or exceeds a designated amount of coin-in (i.e., a bonus sequence eligibility points threshold coin-in amount). Upon the amount of coin-in wagered at one or more gaming devices in the gaming system reaching or exceeding the bonus sequence eligibility points threshold coin-in amount, the gaming system causes one or more bonus sequence eligibility points to be provided. In different embodiments, the bonus sequence eligibility points threshold coin-in amount is predetermined, randomly determined, determined based on a player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day) or determined based on any other suitable method or criteria.

In another embodiment, a bonus sequence eligibility point accumulation event occurs and one or more bonus sequence eligibility points are provided based on an amount coin-out. In this embodiment, the gaming system determines if an amount of coin-out provided by one or more gaming devices in the gaming system reaches or exceeds a designated amount of coin-out (i.e., a bonus sequence eligibility points threshold coin-out amount). Upon the amount of coin-out provided at one or more gaming devices in the gaming system reaching or exceeding the bonus sequence eligibility points threshold coin-out amount, the gaming system causes one or more bonus sequence eligibility points to be provided. In different embodiments, the bonus sequence eligibility points threshold coin-out amount is predetermined, randomly determined, determined based on a player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day) or determined based on any other suitable method or criteria.

In an alternative embodiment, a bonus sequence eligibility point accumulation event occurs and one or more bonus sequence eligibility points are provided based on a predefined variable reaching a defined parameter threshold. For example, when the 500,000$^{th}$ player has played a gaming machine of the gaming system (ascertained from a player tracking system), one or more bonus sequence eligibility points are provided. In different embodiments, the predefined parameter thresholds include a length of time, a length of time after a certain dollar amount is hit, a wager level threshold for a specific machine (which gaming device is the first to contribute $250,000), a number of gaming machines active, or any other parameter that defines a suitable threshold.

In another embodiment, a bonus sequence eligibility point accumulation event occurs and one or more bonus sequence eligibility points are provided based on time. In this embodiment, a time is set for when one or more bonus sequence eligibility points are to be provided. In one embodiment, such a set time is based on historic data.

In another embodiment, a bonus sequence eligibility point accumulation event occurs and one or more bonus sequence eligibility points are provided based upon gaming system operator defined player eligibility parameters stored on a player tracking system (such as via a player tracking card or other suitable manner). In this embodiment, the parameters for eligibility are defined by the gaming system operator based on any suitable criterion. In one embodiment, the central controller/gaming device processor recognizes the player's identification (via the player tracking system) when the player inserts or otherwise associates their player tracking card in the gaming machine. The central server/gaming device processor determines the player tracking level of the player and if the current player tracking level defined by the gaming system operator is eligible for one or more bonus sequence eligibility points. In one embodiment, the gaming system operator defines minimum bet levels required to provide one or more bonus sequence eligibility points based on the player's card level.

In another embodiment, a bonus sequence eligibility point accumulation event occurs and one or more bonus sequence eligibility points are provided based on a system determination, wherein one or more bonus sequence eligibility points are provided due to one or more random selections by the central controller. In one embodiment, the central controller tracks all active gaming machines and the wagers they placed. Each gaming machine has its own entry defining its state as either active or inactive and also defining the values of the wagers from that gaming machine. In one embodiment, active status means that the gaming machine is being actively played by a player and enrolled/inactive status means that the gaming machine is not being actively played by a player. The active status requirements can be based on any suitable number of satisfied criteria or defined in any suitable manner by the implementer of the gaming system. In one such embodiment, based on the gaming machine's state as well as one or more wager pools associated with the gaming machine, the central controller determines whether to provide one or more bonus sequence eligibility points. In one such embodiment, the player who consistently places a higher wager is more likely to be provided one or more bonus sequence eligibility points than a player who consistently places a minimum wager. It should be appreciated that the criteria for determining whether a player is in active status or inactive status to determine if a bonus sequence eligibility point accumulation event occurs may the same as, substantially the same as, or different than the criteria for determining whether a gaming device (or player at that gaming device) is in active status to retain any accumulated bonus sequence eligibility points as described herein.

In another embodiment, a bonus sequence eligibility point accumulation event occurs and one or more bonus sequence eligibility points are provided by determining if any numbers allotted to a gaming device match a randomly selected number. In this embodiment, upon or prior to each play of each gaming machine, a gaming device selects a random number from a range of numbers and during each primary game, the gaming machine allocates the first N numbers in the range, where N is the number of credits bet by the player in that primary game. At the end of the primary game, the randomly selected number is compared with the numbers allocated to the player and if a match occurs, one or more bonus sequence eligibility points are provided. It should be appreciated that any suitable manner of causing one or more bonus sequence eligibility points to be provided may be implemented in accordance with the gaming system and method disclosed herein.

In another embodiment, the bonus sequence triggering event occurs based on an amount coin-in. In this embodiment, the gaming system determines if an amount of coin-in wagered at one or more gaming devices in the gaming system reaches or exceeds a designated amount of coin-in (i.e., a bonus sequence triggering event threshold coin-in amount). Upon the amount of coin-in wagered at one or more gaming devices in the gaming system reaching or exceeding the bonus sequence triggering event threshold coin-in amount, the gaming system causes the bonus sequence triggering event to occur. In different embodiments, the bonus sequence triggering event threshold coin-in amount is predetermined, randomly determined, determined based on a player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

In another embodiment, the bonus sequence triggering event occurs based on an amount coin-out. In this embodiment, the gaming system determines if an amount of coin-out provided by one or more gaming devices in the gaming system reaches or exceeds a designated amount of coin-out (i.e., a bonus sequence triggering event threshold coin-out amount). Upon the amount of coin-out provided at one or more gaming devices in the gaming system reaching or exceeding the bonus sequence triggering event threshold coin-out amount, the gaming system causes the bonus sequence triggering event to occur. In different embodiments, the bonus sequence triggering event threshold coin-out amount is predetermined, randomly determined, determined based on a player's status (such as determined through a player tracking system), determined based on a generated symbol or symbol combination, determined based on a random determination by the central controller, determined based on a random determination at the gaming machine, determined based on one or more side wagers placed, determined based on the player's primary game wager, determined based on time (such as the time of day), determined based on an amount of coin-in accumulated in one or more pools or determined based on any other suitable method or criteria.

In an alternative embodiment, the bonus sequence triggering event occurs based on a predefined variable reaching a defined parameter threshold. For example, when the 500,000$^{th}$ player has played a gaming machine of the gaming system (ascertained from a player tracking system), such a bonus sequence triggering event occurs. In different embodiments, the predefined parameter thresholds include a length of time, a length of time after a certain dollar amount is hit, a wager level threshold for a specific machine (which gaming device is the first to contribute $250,000), a number of gaming machines active, or any other parameter that defines a suitable threshold.

In another embodiment, the bonus sequence triggering event occurs based on time. In this embodiment, a time is set for when such a bonus sequence triggering event will occur. In one embodiment, such a set time is based on historic data.

In another embodiment, the bonus sequence triggering event occurs based upon gaming system operator defined player eligibility parameters stored on a player tracking system (such as via a player tracking card or other suitable manner). In this embodiment, the parameters for eligibility are defined by the gaming system operator based on any suitable criterion. In one embodiment, the central controller/gaming device processor recognizes the player's identification (via the player tracking system) when the player inserts or otherwise associates their player tracking card in the gaming machine. The central server/gaming device processor determines the player tracking level of the player and if the current player tracking level defined by the gaming system operator is eligible for a bonus sequence triggering event. In one embodiment, the gaming system operator defines minimum bet levels required for the bonus sequence triggering event to occur based on the player's card level.

In another embodiment, the bonus sequence triggering event occurs based on a system determination, wherein the bonus sequence triggering event occurs due to one or more random selections by the central controller. In one embodiment, the central controller tracks all active gaming machines and the wagers they placed. Each gaming machine has its own entry defining its state as either active or inactive and also defining the values of the wagers from that gaming machine. In one embodiment, active status means that the gaming machine is being actively played by a player and enrolled/inactive status means that the gaming machine is not being actively played by a player. The active status requirements can be based on any suitable number of satisfied criteria or defined in any suitable manner by the implementer of the gaming system. In one such embodiment, based on the gaming machine's state as well as one or more wager pools associated with the gaming machine, the central controller determines whether the triggering event occurs in association with that player. In one such embodiment, the player who consistently places a higher wager is more likely to cause a triggering event to occur than a player who consistently places a minimum wager. It should be appreciated that the criteria for determining whether a player is in active status or inactive status for the bonus sequence triggering event to occur may the same as, substantially the same as, or different than the criteria for determining whether a gaming device (or player at that gaming device) is in active status to retain any accumulated bonus sequence eligibility points as described herein.

In another embodiment, the bonus sequence triggering event occurs by determining if any numbers allotted to a gaming device match a randomly selected number. In this embodiment, upon or prior to each play of each gaming machine, a gaming device selects a random number from a range of numbers and during each primary game, the gaming machine allocates the first N numbers in the range, where N is the number of credits bet by the player in that primary game. At the end of the primary game, the randomly selected number is compared with the numbers allocated to the player and if a match occurs, such a triggering event occurs for the player at that particular gaming machine. It should be appreciated that any suitable manner of causing a bonus sequence triggering event to occur may be implemented in accordance with the gaming system and method disclosed herein.

Information Provided to Player

As indicated above, the bonus sequence eligibility points and/or triggering of the bonus sequence may be provided to the players of the gaming machines with or without explanation or information provided to the player, or alternatively information can be displayed to the player. In one embodiment, suitable information about these bonus sequence eligibility points and/or triggering of the bonus sequence can be provided to the players through one or more displays on the gaming machines or additional information displays positioned near the gaming machines, such as above a bank of system gaming machines.

This information can be used to entertain the player or inform the player that a bonus sequence eligibility point accumulation event and/or a bonus sequence triggering event has occurred or will occur. Examples of such information are:

(1) that a bonus sequence eligibility point accumulation event and/or a bonus sequence triggering event has occurred;

(2) that a bonus sequence eligibility point accumulation event and/or a bonus sequence triggering event will shortly occur (i.e., foreshadowing the possible providing of a progressive award);

(3) that one or more bonus sequence eligibility points and/or progressive awards have been provided to one or more players of the system gaming machines;

(4) which gaming machines have won the bonus sequence eligibility points or progressive awards;

(5) the amount of the provided bonus sequence eligibility points or progressive awards;

(6) the highest progressive award or quantity of bonus sequence eligibility points provided;

(7) the lowest progressive award or quantity of bonus sequence eligibility points provided;

(8) the average progressive award or quantity of bonus sequence eligibility points provided;

(9) number of games played/total time since the last progressive award or quantity of bonus sequence eligibility points were provided;

(10) the average time between progressive awards or quantity of bonus sequence eligibility points being provided;

(11) the number of progressive awards or bonus sequence eligibility points provided in a designated time period; and

(12) the amount of the progressive awards or quantities of bonus sequence eligibility points that can be provided.

It should be appreciated that such information can be provided to the players through any suitable audio, audio-visual or visual devices.

It should be understood that various changes and modifications to the presently preferred embodiments described herein will be apparent to those skilled in the art. Such changes and modifications can be made without departing from the spirit and scope of the present invention and without diminishing its intended advantages. It is therefore intended that such changes and modifications be covered by the appended claims.

The invention is claimed as follows:

1. A gaming system comprising:

at least one processor, and at least one memory device which stores a plurality of instructions which when executed by the at least one processor, cause the at least one processor to:

distinct from any placement of any wagers associated with any plays of any primary games, accumulate a first quantity of bonus sequence eligibility points for a first player at a first one of a plurality of thick client electronic gaming devices responsive to a first bonus sequence eligibility point accumulation event occurring in association with the first one of said gaming devices, said first quantity of bonus sequence eligibility points being greater than zero and each of the plurality of thick client electronic gaming machines comprises a plurality of input devices including a payment acceptor, at least one display device, at least one thick client electronic gaming device processor, and at least one thick client electronic gaming device memory device which stores a plurality of regulatory gaming commission approved instructions which when executed by the at least one thick client electronic gaming device processor, cause the at least one thick client electronic gaming device processor to: responsive to a physical item being received via the payment acceptor, establish a credit balance based, at least in part, on a monetary value associated with the received physical item, wherein the physical item is selected from the group consisting of: a ticket associated with the monetary value and a unit of currency, responsive to an amount of the credit balance being at least equal to a minimum wager amount, receive a placement of a wager on a play of a primary game, wherein the amount of the credit balance is decreasable based on an amount of the wager placed on the play of the primary game, for the wagered on play of the primary game: determine a primary game outcome, cause the at least one display device to display the determined primary game outcome, determine any primary game award amount associated with the displayed primary game outcome, and cause the at least one display device to display any determined primary game award amount, wherein the amount of the credit balance is increasable based on any determined primary game award amount, and responsive to a cashout input being received, cause an initiation of any payout associated with the credit balance;

distinct from any placement of any wagers associated with any plays of any primary games, accumulate a second, different quantity of bonus sequence eligibility points for a second player at a second one of said plurality of thick client electronic gaming devices responsive to a second bonus sequence eligibility point accumulation event occurring in association with the second one of said gaming devices, said second, different quantity of bonus sequence eligibility points being greater than zero;

cause a display of a first progressive award amount for the first player at the first one of said plurality of thick client electronic gaming devices, wherein said first progressive award amount for the first player is determined in accordance with the first quantity of bonus sequence eligibility points accumulated for the first player, a base amount and an incremental amount;

cause a display of a second, different progressive award amount for the second player at the second one of said plurality of thick client electronic gaming devices, wherein said second, different progressive award amount for the second player is determined in accordance with the second, different quantity of bonus sequence eligibility points accumulated for the second player, the base amount and the incremental amount; and responsive to an occurrence of a triggering event, cause one of said progressive award amounts to be provided to one of the players at one of said plurality of thick client electronic gaming devices, wherein the triggering event is associated with the first one of said plurality of thick client electronic gaming devices and the second one of said plurality of thick client electronic gaming devices.

2. The gaming system of claim 1, wherein when executed by the at least one processor, the instructions cause the at least one processor to cause a display of: (i) a plurality of progressive award amounts for the first player at the first one of said plurality of thick client electronic gaming devices, wherein each of said plurality of progressive award amounts are determined in accordance with the first quantity of bonus sequence eligibility points accumulated for the first player, and (ii) a plurality of different progressive award amounts for the second player at the second one of said plurality of thick client electronic gaming devices, wherein each of said plurality of different progressive award amounts are determined in accordance with the second, different quantity of bonus sequence eligibility points accumulated for the second player.

3. The gaming system of claim 1, wherein each bonus sequence eligibility point accumulation event occurs independent of any displayed events in any plays of any of the primary games of the plurality of thick client electronic gaming devices.

4. A gaming system comprising:

at least one processor, and at least one memory device which stores a plurality of instructions which when executed by the at least one processor, cause the at least one processor to:

distinct from any placement of any wagers associated with any plays of any primary games, accumulate a quantity of bonus sequence eligibility points for a player at one of a plurality of thick client electronic gaming devices responsive to a bonus sequence eligibility point accumulation event occurring in association with said at least one gaming device, wherein each bonus sequence eligibility point has an associated value and the quantity of bonus sequence eligibility points is greater than zero, and each of the plurality of thick client electronic gaming machines comprises a plurality of input devices including a payment acceptor, at least one display device, at least one thick client electronic gaming device processor, and at least one thick client electronic gaming device memory device which stores a plurality of regulatory gaming commission approved instructions which when executed by the at least one thick client electronic gaming device processor, cause the at least one thick client electronic gaming device processor to: responsive to a physical item being received via the payment acceptor, establish a credit balance based, at least in part, on a monetary value associated with the received physical item, wherein the physical item is selected from the group consisting of: a ticket associated with the monetary value and a unit of currency, responsive to an amount of the credit balance being at least equal to a minimum wager amount, receive a placement of a wager on a play of a primary game, wherein the amount of the credit balance is decreasable based on an amount of the wager placed on the play of the primary game, for the wagered on play of the primary game: determine a primary game outcome, cause the at least one display device to display the determined primary game outcome, determine any primary game award amount associated with the displayed primary game outcome, and cause the at least one display device to display any determined primary game award amount, wherein the amount of the credit balance is increasable based on any determined primary game award amount, and responsive to a cashout input being received, cause an initiation of any payout associated with the credit balance;

randomly determine whether to provide the player the associated value of at least one of said accumulated bonus sequence eligibility points; and responsive to the determination being to provide the player the associated value of at least one of said accumulated bonus sequence eligibility points, cause a display of the associated value of at least one of said accumulated bonus sequence eligibility points.

5. The gaming system of claim 4, wherein when executed by the at least one processor responsive to one of said plurality of thick client electronic gaming devices being determined to be in an inactive state, the instructions cause said at least one processor to: cause at least one of any accumulated bonus sequence eligibility points accumulated for the player at said gaming device to be forfeited, and contribute at least part of the associated value of each forfeited bonus sequence eligibility point to a first bonus sequence award.

6. The gaming system of claim 5, wherein when executed by the at least one processor, the instructions cause the at least one processor to provide at least part of the associated value of each forfeited bonus sequence eligibility point.

7. The gaming system of claim 4, wherein when executed by the at least one processor responsive to the player at one of said plurality of thick client electronic gaming devices participating in a bonus sequence and not being provided a second bonus sequence award, the instructions cause said at least one processor to contribute at least part of the associated value of each of the accumulated bonus sequence eligibility points accumulated for the player at that thick client electronic gaming device to a first bonus sequence award.

8. The gaming system of claim 7, wherein when executed by the at least one processor responsive to the player at that thick client electronic gaming device participating in the bonus sequence and not being provided the second bonus sequence award, the instructions cause the at least one processor to provide at least part of the associated value of each of the player's accumulated bonus sequence eligibility points to the player.

9. The gaming system of claim 7, wherein the first bonus sequence award and the second bonus sequence award are the same.

10. The gaming system of claim 4, wherein each bonus sequence eligibility point accumulation event occurs independent of any displayed events in any plays of any of the primary games of said plurality of thick client electronic gaming devices.

11. The gaming system of claim 4, wherein when executed by the at least one processor responsive to a bonus sequence triggering event occurring and at least one bonus sequence eligibility point being accumulated for at least one of the players at at least one of said plurality of thick client electronic gaming devices, the instructions cause said at least one processor to select one of the players to provide a bonus sequence award, wherein each player's chance of being selected is determined in accordance with said player's accumulated bonus sequence eligibility points relative to a total quantity of bonus sequence eligibility points accumulated for all of the players.

12. The gaming system of claim 11, wherein when executed by the at least one processor, the instructions cause the at least one processor to provide the selected player a progressive award which is determined, at least in part, in accordance with the player's accumulated bonus sequence eligibility points.

13. The gaming system of claim 11, wherein when executed by the at least one processor responsive to the bonus sequence triggering event occurring and at least one bonus sequence eligibility point being accumulated for a plurality of the players at said plurality of thick client electronic gaming devices, for at least one player not selected to provide the bonus sequence award, the instructions cause the at least one processor to contribute at least part of the associated value of each of said player's accumulated bonus sequence eligibility points to the bonus sequence award.

14. A gaming system comprising:

at least one processor, and at least one memory device which stores a plurality of instructions which when executed by the at least one processor, cause the at least one processor to:

distinct from any placement of any wagers associated with any plays of any primary games, accumulate a first quantity of bonus sequence eligibility points for a first player at a first one of a plurality of thin client gaming devices responsive to a first bonus sequence eligibility point accumulation event occurring, said first quantity of bonus sequence eligibility points being greater than zero;

distinct from any placement of any wagers associated with any plays of any primary games, accumulate a second, different quantity of bonus sequence eligibility points for a second player at a second one of said thin client gaming devices responsive to a second bonus sequence eligibility point accumulation event occurring, said second, different quantity of bonus sequence eligibility points being greater than zero;

cause a display of a first progressive award amount for the first player at the first one of said thin client gaming devices, wherein said first progressive award amount for the first player is determined in accordance with the first quantity of bonus sequence eligibility points accumulated for the first player, a base amount and an incremental amount;

cause a display of a second, different progressive award amount for the second player at the second one of said thin client devices, wherein said second, different progressive award amount for the second player is determined in accordance with the second, different quantity of bonus sequence eligibility points accumulated for the second player, the base amount and the incremental amount; and responsive to an occurrence of a triggering event, cause one of said progressive award amounts to be provided to one of the players at one of said thin client gaming devices, wherein the triggering event is associated with the first one of said thin client gaming devices and the second one of said thin client gaming devices.

* * * * *